US011705684B2

(12) United States Patent
Sorg

(10) Patent No.: US 11,705,684 B2
(45) Date of Patent: Jul. 18, 2023

(54) METHOD FOR MANUFACTURING AN ELECTRIC CABLE

(71) Applicants: METZNER MASCHINENBAU GMBH, Neu-Ulm (DE); METZNER HOLDING GMBH, Ulm (DE)

(72) Inventor: Manfred Sorg, Ulm (DE)

(73) Assignee: Metzner Holding GmbH, Ulm (DE)

( * ) Notice: Subject to any disclaimer, the term of this patent is extended or adjusted under 35 U.S.C. 154(b) by 0 days.

(21) Appl. No.: 17/629,538

(22) PCT Filed: Jul. 15, 2020

(86) PCT No.: PCT/EP2020/070011

§ 371 (c)(1),
(2) Date: Jan. 24, 2022

(87) PCT Pub. No.: WO2021/013653

PCT Pub. Date: Jan. 28, 2021

(65) Prior Publication Data

US 2022/0255279 A1 Aug. 11, 2022

(30) Foreign Application Priority Data

Jul. 22, 2019 (DE) ..... 10 2019 119 726.0

(51) Int. Cl.
*H01R 43/28* (2006.01)
*H01R 43/048* (2006.01)

(52) U.S. Cl.
CPC ..... *H01R 43/28* (2013.01); *H01R 43/048* (2013.01); *Y10T 29/49185* (2015.01)

(58) Field of Classification Search
CPC ..... H01R 13/65917; H01R 9/0518; H01R 13/6581; H01R 13/6592; H01R 9/2416;
(Continued)

(56) References Cited

U.S. PATENT DOCUMENTS 5,127,159 A * 7/1992 Kudo ..... H01R 43/28 29/863
5,208,977 A 5/1993 Ricard
(Continued)

FOREIGN PATENT DOCUMENTS

EP 3093933 A1 11/2016

OTHER PUBLICATIONS

International Search Report dated Oct. 5, 2020.

*Primary Examiner* — Thiem D Phan
(74) *Attorney, Agent, or Firm* — Randall Danskin P.S.

(57) ABSTRACT

The invention relates to a method for manufacturing an electric cable (2), according to which the cable (2) is successively processed in processing modules (41, 43) that are independent from one another. According to the invention, at least one sheath clamp (10.1, 10.2, 10.3, 10.4), which is independent from the plug connectors (22) that are to be mounted on the cable (2) during manufacturing, is attached to a cable sheath (9) of the cable (2) in a non-positive fit at a defined axial position along the longitudinal axis (L) of the cable (2). Alternatively or in addition, the cable (2) is attached to a cable carrier (4), wherein the cable carrier (4) comprises at least one stop element (44) which is arranged at a defined axial position along the longitudinal axis (L) of the cable (2).

1 Claim, 6 Drawing Sheets

(58) Field of Classification Search
CPC ..... H01R 43/28; H01R 43/048; H02G 1/14; Y10T 29/49185
USPC ..... 29/863, 33 M, 33 F, 747, 748, 759, 760, 29/854, 857, 861, 867, 872
See application file for complete search history.

(56) References Cited

U.S. PATENT DOCUMENTS

| | | | | |
|---|---|---|---|---|
| 7,243,415 | B2 * | 7/2007 | Revel | H01R 43/20 29/748 |
| 2007/0178742 | A1 | 8/2007 | Shigemi | |

* cited by examiner

METHOD FOR MANUFACTURING AN ELECTRIC CABLE

CROSS-REFERENCE TO RELATED APPLICATIONS

This US National Stage Non-Provisional Patent Application claims priority to earlier filed PCT Patent Application on No. PCT/EP2020/070011 which was filed on 15 Jul. 2020 (and published as WO 2021/013653 A1 on 28 Jan. 2021), and also claims priority to earlier filed German Patent Application No. 10 2019 119 726.0 which was filed on 22 Jul. 2019. The entire contents of both the aforementioned earlier filed PCT Patent Application and the aforementioned German Patent Application are both expressly and fully incorporated herein by this reference.

Pursuant to USPTO rules, this priority claim to earlier filed PCT Patent Application No. PCT/EP2020/070011 which was filed on 15 Jul. 2020, and earlier filed German Patent Application No. 10 2019 119 726.0 which was filed on 22 Jul. 2019 are both also included in the Application Data Sheet (ADS) filed herewith.

TECHNICAL FIELD

The invention relates to a method for manufacturing an electric cable.

The invention further relates to a sheath clamp for reversible fastening to a cable sheath of an electric cable and to a cable carrier for receiving an electric cable to be manufactured.

The invention also relates to a device and to a system for manufacturing an electric cable.

BACKGROUND

When manufacturing cables, the cable conductors are typically connected to a plug-in connector in order to be able to subsequently establish electrical connections with other cables or conductors which have corresponding plug-in connectors or mating plug-in connectors. A plug-in connector or mating plug-in connector may be, without limitation, a plug, a built-in plug, a socket, a coupling or an adapter. The term "plug-in connector" or "mating plug-in connector" used within the scope of the invention is representative of all variants.

Exacting requirements with respect of robustness and the security of the plug-in connections are imposed in particular on plug-in connectors for the automotive industry or for vehicles. Electromobility in particular poses challenges for the automotive industry and its suppliers since high currents with voltages of up to 1500 V are sometimes transmitted in the vehicles via the cables and/or lines. With regard to the danger that would result from a failure of components in an electric vehicle, it is accordingly necessary for particularly exacting requirements to be imposed on the quality of the cables and/or lines and plug-in connections.

Accordingly, a plug-in connection has to withstand sometimes high loads, for example mechanical loads, and remain closed in a defined fashion, so that the electrical connection is not inadvertently severed, for example during operation of a vehicle.

For reasons of quality monitoring and in order to make the cable manufacturing process as transparent as possible and comprehensible for the end customer, it may be advantageous to document the manufacture of the individual cables.

Documentation of the cable processing that can be traced back as far as individual cables is complex, in particular with regard to fully or partially automated cable manufacture.

A further requirement made of plug-in connectors, in particular for the automotive industry, is that said plug-in connectors have to be able to be produced economically in large quantities. For this reason, as fully automated cable manufacture as possible is preferable, in particular for manufacturing cables for the automotive industry. Corresponding production lines therefore have to be established in order to achieve the required quantities with simultaneously high quality.

In view of the known prior art, the object of the present invention is to provide an advantageous method for manufacturing an electric cable which is highly suitable for automated cable processing in particular.

The present invention is also based on the object of providing an advantageous sheath clamp for fastening to a cable sheath of a cable and a cable carrier for receiving an electric cable to be manufactured.

Finally, an object of the invention is also to provide an advantageous device and an advantageous system for manufacturing an electric cable which may be highly suitable for automated cable processing in particular.

The features described and disclosed herein relate to advantageous embodiments and variants of the invention.

A method for manufacturing an electric cable, according to which method the cable is processed in mutually independent processing modules in succession, is provided.

In particular, the invention may be provided for automated or fully automated manufacture of an electric cable.

The electric cable is preferably formed as a high-voltage line.

The method may be provided for manufacturing a single-core cable, which has a single inner conductor, and/or for manufacturing a multicore cable, which has a plurality of inner conductors.

That region of the electric cable in which the processing, or the manufacture, primarily takes place is sometimes also referred to herein as the "cable section to be processed". The cable section to be processed may be a cable end piece. Preferably, two cable sections of the cable, in particular both cable end pieces, are processed or manufactured with a respective plug-in connector.

In principle, any desired electric cable with any desired plug-in connectors may be manufactured in the context of the invention. The electric cable preferably has an outer conductor or is formed as a shielded electric cable. The invention is particularly advantageously suitable for manufacturing electric cables with a large cross section for high power transmission, for example in the automotive sector, particularly preferably in the field of electromobility. It is thus possible for an electric cable for the high-voltage range to be provided, in particular a high-voltage line.

The multicore electric cable may have any desired number of inner conductors, for example two inner conductors or more inner conductors, three inner conductors or more inner conductors, four inner conductors or even more inner conductors. The inner conductors may run in a twisted fashion through the cable, in the manner of a twisted pair cable known from telecommunications or communications engineering. However, the inner conductors may also be guided in parallel in the cable.

The multicore electric cable is particularly preferably formed as a cable shielded with exactly one outer conductor and having exactly two inner conductors.

The single-core electric cable is preferably formed as a coaxial cable with exactly one inner conductor and exactly one outer conductor.

Provision may preferably also be made for the electric cable to be manufactured with a plug-in connector in which more than one cable, in particular two cables, particularly preferably two single-core coaxial cables, can be received. In the context of the invention, an electrical plug-in connector can therefore be fitted to, for example, two electric cables. The method according to the invention can accordingly be executed several times sequentially or in parallel.

In the context of the invention, an inner conductor is understood to mean, in particular, a line running through the cable, which line is composed of an insulation and of an electrical conductor (core) running within the insulation. The electrical conductor or the core may be formed as a single wire or as a composite of multiple wires (also referred to as a stranded wire). In principle, however, the inner conductor mentioned in the context of the invention may also be composed exclusively of the electrical conductor or the core, or may also have yet further components in addition to the insulator.

By virtue of the fact that, according to the invention, the cable manufacture is distributed across mutually independent processing modules or processing processes, the method or the system to be described further herein may be operated as an "assembly line process" or as a "cycle machine" with successive individual steps, in order to reduce the processing time for mass processing.

The individual processing modules may further be of modular construction, as a result of which individual processing modules of the system can be replaced, modified or removed without a great deal of effort. In this way, the method can be configurable with simple means, in particular for processing different types of cable.

According to the invention, provision is made for at least one sheath clamp to be fastened to a cable sheath of the cable in a non-positively locking fashion at a defined axial position along a longitudinal axis of the cable. As an alternative, or in addition, provision is made for the cable to be fastened to a cable carrier, wherein the cable carrier has at least one stop element which is arranged at a defined axial position along the longitudinal axis of the cable.

The sheath clamp is independent of the plug-in connector to be fitted on the cable in the course of the manufacturing process. In particular, the sheath clamp is therefore not a plug-in connector component which is later part of the plug-in connector.

The sheath clamp may preferably be a clamp for holding objects together in a non-positively locking fashion.

The sheath clamp may have a clamping region for fastening to the cable sheath. The clamping region may have, for example, two or more clamping jaws, for example clamping jaws composed of a plastic, for example only, and not limited to, rubber. The clamping region may optionally also have one or more claws in order to further strengthen the fastening to the cable sheath. However, the use of claws is not preferred owing to the associated adverse effect on the cable sheath.

The sheath clamp may furthermore have an actuation region. The actuation region may be actuated, in particular, by a user or by a device for handling and/or fastening the sheath clamp. In particular, the actuation region may serve to at least partially open the sheath clamp—preferably counter to a spring force for closing the sheath clamp—for the purposes of fastening to the cable sheath of the cable.

The sheath clamp may preferably have two clamping limbs which are connected to one another in a central section, wherein the first ends of the clamping limbs form the actuation region and the second ends of the clamping limbs form the clamping region. A spring may be arranged at the connection region of the two clamping limbs, which spring presses the two clamping limbs together by way of their respective second ends.

In principle, the sheath clamp may have any desired structure. The sheath clamp may, for example, also have one or more elastic fastening rings or be composed of one or more elastic fastening rings. For example, an elastic fastening ring may be formed from a plastic, preferably rubber (in the manner of a rubber seal), in order to be clamped in a non-positively locking fashion on the cable sheath. Resilient, part-ring-shaped fastening rings, for example composed of a metal, may also be provided.

Furthermore, the sheath clamp may also be of magnetic form, for example. For this purpose, the sheath clamp may have, for example, two half-shells that are magnetically connectable to one another.

By virtue of the fact that, according to the invention, at least one sheath clamp is fastened to the cable sheath of the cable, there are various resulting advantages in the manufacture of the cable, in particular in the handling and identification of the cable in the course of the processing by mutually independent processing modules.

The cable carrier may be part of a workpiece carrier system. For example, the cable carrier may be movable between the processing modules by means of a transportation device in order to feed the cable to the processing modules in order to be processed.

The stop elements may be formed, in particular, as pins or webs on the cable carrier.

In each case two stop elements, which are arranged at the same axial position and between which the cable fastened in the cable carrier runs, preferably form a stop element pair. With preference, at least one stop element pair, preferably a plurality of stop element pairs, for example two, three, four, five, six, seven, eight, nine, ten or even more stop element pairs, is/are provided.

The stop elements may be able to be flexibly fitted or positioned on the cable carrier manually or by machine/automatically in order to assume various axial positions as required. The stop elements may be able to be positioned on the cable carrier freely or in a specified pattern.

The stop elements may be positioned on the cable carrier equidistantly along the longitudinal axis.

The stop elements may be able to be fed in the direction of the longitudinal axis of the cable manually or by machine/automatically. The stop elements may be able to be displaced, for example, along a respective guide rail in the direction of the longitudinal axis of the cable.

The stop elements may optionally be of elastic or resilient form in order to bear against the cable sheath in a non-positively locking fashion when the cable is in the inserted state.

In an advantageous development of the invention, provision may be made for the sheath clamp to be pushed onto the cable sheath of the cable starting from a front, free end of the cable until the defined axial position is reached.

For pushing the at least one sheath clamp onto the cable sheath of the cable, the cable may be fed to the sheath clamp and/or the sheath clamp may be fed to the cable.

In order to be able to advantageously push the sheath clamp onto the cable sheath, the clamping region of the sheath clamp, for example two or more clamping jaws of the sheath clamp or an elastic fastening ring of the sheath clamp, may be at least partially spread apart beforehand.

In order to assist the pushing-on process, the use of a lubricant may also be provided, said lubricant being applied to the sheath clamp and/or to the cable sheath of the cable. The lubricant may be, for example, an alcohol or particularly preferably an oil, for example a silicone oil.

For example, 2-propanol (also known as isopropyl alcohol or isopropanol) may be used as a lubricant.

However, a silicone oil, that is to say a synthetic, silicon-based oil, is very particularly preferably used as the lubricant. For example, a polydimethylsiloxane with a high content of phenyl groups may be used, in particular a silicone oil known under the trade name WACKER® AP 150 from Wacker Chemie AG.

Provision may be made to use a lubricant for pushing-on a plug-in connector component and/or a sheath clamp that is already contained in the cable. For example, to form the cable sheath, for example, use is sometimes made of self-lubricating silicones which, after the vulcanization process, exude the oil on the surface. The use of the lubricants, in particular silicone oils, that are already used in any case in the cable for self-exudation is generally harmless in terms of safety.

Provision may also be made to generate a compressed-air film between the cable sheath and the plug-in connector component and/or the sheath clamp in order to improve the sliding characteristics when pushing-on the plug-in connector component or the sheath clamp.

It is thus possible, for example, to dispense with an additional lubricant.

In order to generate the compressed-air film, provision may be made to partially enclose the plug connector component or the sheath clamp with a mold part and to optionally support said plug-in connector component or sheath clamp on the cable sheath. The compressed air can thus preferably flow exclusively (or at least substantially) through the gap between the plug-in connector component or the sheath clamp and the cable sheath and thereby widen the gap or generate said gap in the first place. The compressed air can thus advantageously and extremely gently widen a passage bore of the plug-in connector component or the sheath clamp. At the same time, an axial displacement of the plug-in connector component or the sheath clamp on the cable sheath of the cable can be additionally improved by the air film.

According to a development of the invention, provision may be made for the sheath clamp to be attached to the cable sheath of the cable at a defined axial position radially in the direction of the center axis of the cable.

Provision may therefore also be made for the sheath clamp to be firstly spread apart in such a way that it can be attached radially to the cable sheath. In particular, it is thus possible to avoid an axial pushing-on process over a relatively long section of the cable sheath, and the associated complexity.

Radially pushing-on the sheath clamp may be suitable, in particular, for sheath clamps that are part-ring-shaped or formed in the manner of a clip.

According to a development of the invention, provision may be made for the at least one sheath clamp to be removed from the cable sheath of the cable again after processing by at least one of the processing modules, preferably after processing by all of the processing modules.

In principle, however, provision may also be made for at least one of the sheath clamps not to be removed and to be delivered, for example, together with the manufactured electric cable.

The at least one sheath clamp is preferably assigned to the cable throughout the entire manufacturing process.

If the sheath clamp has one or more fastening rings or irreversibly closed lashing elements, these can be cut open where necessary. However, the sheath clamp is preferably removed from the cable in a non-destructive manner.

In a development of the invention, provision may be made for the sheath clamp to be made identifiable by way of an information carrier in order to be able to uniquely identify the cable while it is being processed.

By virtue of the fact that the cable is made identifiable by the information carrier of the sheath clamp, the method according to the invention is particularly advantageously suitable for use in the course of automated or fully automated manufacture of the electric cable.

In a development of the invention, provision may be made for documentation of the processing of the cable to be compiled for at least one processing process of one of the processing modules and to be assigned to the sheath clamp fastened to the cable.

Documentation of the processing of the cable is preferably assigned taking into consideration information imprinted onto or into the information carrier.

In an advantageous development of the invention, provision may be made for the documentation to be at least partially imprinted into the information carrier of the sheath clamp.

If the information carrier is suitable for storing data, the documentation may advantageously already be imprinted (in full or in part) into or onto the information carrier.

In a development of the invention, provision may be made for a unique identifier for the cable to be imprinted into the information carrier or for a unique identifier which is already present on the information carrier to be assigned to the cable.

The cable may therefore be uniquely identifiable on the basis of the identifier in the course of the cable manufacture—and preferably also later.

The cable may be made identifiable by applying and/or modifying the information carrier of the sheath clamp. Provision may thus be made for the information carrier (and optionally the identifier) to be applied to the sheath clamp for the first time in the course of the method, for example at the beginning of the electric cable manufacturing process. The information carrier may be, for example, printed or adhesively bonded on, for example in the manner of a label in the course of a labeling process.

An information carrier of the sheath clamp, which information carrier is already present, may however optionally also be modified in order to make the cable identifiable. For example, information may be added to the information carrier or information on the information carrier may be revised.

In particular when the information carrier already has an identifier, the need for imprinting an identifier may be eliminated. The identifier already present, for example a consecutive master number of sheath clamps, may therefore be used to uniquely identify the cable (at least in the course of the cable manufacturing process).

In an advantageous development of the invention, provision may be made for the information carrier to be of optical and/or electronic form.

An information carrier of optical or electronic form has proven to be particularly suitable. In principle, however, it is also possible in the context of the invention for a magnetic, haptic and/or some other information carrier to be provided.

Provision may be made for a global database to be used, in which documentation compiled in the course of the cable manufacturing process is assigned to individual cables, preferably on the basis of the unique identifier.

Owing to the use of a global database, the possible flexibility in the storage and assignment of the documentation is particularly advantageous. The information carrier, in particular an identifier contained in the information carrier, may be usable in the database as a designation of the dataset which has the documentation of a specific cable.

In an advantageous development of the invention, provision may be made for the optical information carrier to be formed as a barcode, numerical code and/or 2D code, for example a data matrix code or QR code.

The codes mentioned have proven to be particularly suitable for forming an optical information carrier.

It may be advantageous to equip the information carrier with an error correction method, for example to provide redundant information. In particular, an optical information carrier may sometimes be susceptible to errors during the reading-out of the information.

The same identifier may possibly also be assigned to the same cable multiple times owing to the use of several sheath clamps. In particular, provision may be made to fasten a corresponding sheath clamp to both cable ends.

In an advantageous development of the invention, provision may be made for the electronic information carrier to comprise at least one programmable memory module, for example an RFID transponder, which is modified to identify the cable and/or to document the processing of the cable.

In the context of the invention, an electronic information carrier, for example an RFID transponder, may particularly advantageously be used, for example, also to store the documentation or at least parts of the documentation electronically and to link said documentation or parts of the documentation directly to the sheath clamp or to the cable.

In an advantageous refinement of the invention, provision may be made for the documentation to be used in the context of quality management. Quality assurance or quality control to ensure the defined quality requirements is particularly relevant in particular in the context of the manufacture of an electric cable for the automotive industry. The documentation according to the invention may be particularly advantageous for this purpose.

In an advantageous refinement of the invention, provision may also be made for the cable to be sorted or reprocessed in a manner dependent on the information contained in the documentation. For example, provision may be made for the cable to be sorted into different quality classes in a manner dependent on the information contained in the documentation. Provision may also be made for the cable to be sorted out and removed from the production chain in a manner dependent on the information contained in the documentation.

In a refinement of the invention, provision may be made for information relating to a successful processing process, an incorrect processing process, a failed processing process and/or at least one process parameter of the processing process to be recorded in the documentation. For example, the successful processing, incorrect processing, failed processing and/or at least one process parameter may be recorded in the documentation for each of the mutually independent processing processes or for each of the mutually independent processing modules. The process parameter may be, for example, a parameter that particularly characterizes the processing process. The process parameter may be, for example only and without limitation, a force, a moment and/or a pressure. For example, the intended pressing force, and/or actual pressing force detected by measurement, of a crimping process may be recorded in the documentation. If failed and/or incorrect processing has been documented, provision may be made to terminate the cable manufacturing process for the corresponding cable. A subsequent processing module may, for example, read out the documentation of the cable to be processed prior to the commencement of the cable processing operation and check whether the cable is approved for processing. The cable may optionally be transferred onward by the individual processing modules in each case without being processed, until said cable has left the production line.

In an advantageous refinement of the invention, provision may be made for the information for the documentation to be detected by a control unit using a communication interface and/or a sensor device. That information of the individual processing processes which is relevant for the documentation may be read out, for example, by a controller of a respective processing module (for example specified process parameters and/or process parameters actually detected by measurement during the processing). The respective processing modules may have dedicated sensors in order to detect the relevant information. In particular for checking of the processing processes performed on the cable in the context of quality management, it is also possible for a separately formed sensor device to be provided which is communicatively connected to the control unit and which transmits results of the check, for example of the checks listed above, to the control unit for compiling the documentation.

Provision may be made, in particular, of a check for the presence of certain plug-in connector components of a plug-in connector to be fitted on the cable end (fitting check).

In a development of the invention, provision may be made for the cable sheath of the cable to be fitted with one or more plug-in connector components for later plug-in connector fitting starting from a front, free end of the cable.

The plug-in connector components may be any desired components of the electrical plug-in connector that is to be fitted on the corresponding cable end, which components preferably have a respective passage bore for receiving the cable. The plug-in connector components can thus be pushed onto the electric cable, in particular onto the cable sheath of the cable. The diameter of the passage bores may substantially correspond to the diameter of the electric cable or of its cable sheath. The diameter of the passage bore may however also be larger or slightly smaller than the diameter of the electric cable or of its cable sheath in order to be able to influence the mechanical play of a plug-in connector component pushed onto the cable.

In the context of the invention, the electric cable may, in principle, be fitted with any desired plug-in connector components, some of which will be described below by way of example only, but not as a limitation.

The cable may be fitted with the plug-in connector components manually, for example by a production technician, or by machine/automatically. This also applies to fitting of the sheath clamp(s).

According to a development of the invention, provision may be made for the at least one sheath clamp to be arranged axially adjacent to the at least one plug-in connector component on the cable sheath in order to block a displacement path of the plug-in connector component on the cable sheath in a positively locking fashion.

In an advantageous development of the invention, it may also be the case that the at least one stop element of the cable carrier is arranged axially adjacent to the at least one plug-in connector component along the longitudinal axis of the cable in order to block the displacement path of the plug-in connector component on the cable sheath in a positively locking fashion.

Sometimes, plug-in connector components are loose or axially displaceable on the cable sheath until they are joined together with other plug-in connector components in the course of the plug-in connector fitting process and are fastened to the cable sheath or to some other component of the cable. In order, after the fitting of the cable sheath in the course of the further processing and/or in the course of the transportation of the cable between individual processing modules, to prevent plug-in connector components from being displaced in an uncontrolled manner on the cable sheath (for example moving too close to one another for the subsequent processing or even sliding into one another) or even falling off the cable sheath, the sheath clamps and/or the stop elements may advantageously be suitable for securing the axial positions of the plug-in connector components.

The invention is accordingly suitable, in particular, for processing the cable in mutually independent processing modules, according to which the cable has to be moved between the individual processing modules. In particular, transportation of the cable may be problematical and cause displacement or even loss of previously pushed-on plug-in connector components. This can be avoided using the sheath clamps and/or stop elements according to the invention.

In an advantageous development of the invention, a fitting module with individual chambers for receiving plug-in connector components and sheath clamps may be provided, the individual chambers being arranged in such a way that the plug-in connector components and sheath clamps which are received in the chambers form a common channel with a common center axis (M). An actuator device may be provided and designed to conduct the cable, by way of its front end, along the center axis (M) through the plug-in connector components and the sheath clamps in order to push the plug-in connector components and the sheath clamps axially onto the cable sheath of the cable. As an alternative, or in addition to an actuator device, the cable may accordingly also be guided through the plug-in connector components and the sheath clamps manually, for example by a production technician.

The chambers of the fitting module are preferably designed to receive in each case only a single plug-in connector component or a single sheath clamp. The chambers are particularly preferably structurally separated from one another, for example by respective walls, which walls, however, have cutouts for leading the electric cable through and possibly additionally shape the channel for leading the electric cable through or are able to guide the electric cable as it is being led through. The chambers may, however, also be merely "imaginary" regions within the fitting module that are not structurally separated from one another.

With preference, the channel runs linearly, or the chambers are arranged linearly one behind the other. The arrangement of the chambers relative to one another or the channel may, however, also have a curved profile.

The actuator device may be designed to move the cable and/or the fitting module. It may thus be possible, in particular, for a relative movement between the cable and the fitting module to be provided in order to push the plug-in connector components or the at least one sheath clamp onto the cable sheath of the cable. The electric cable is preferably pushed into the fitting module. For this purpose, the actuator device may have, for example, a roller conveyor device with one, two or even more rollers in order to guide the electric cable linearly between the rollers.

By virtue of the fact that the plug-in connector components and at least one of the sheath clamps are arranged in the chambers of the fitting module, the plug-in connector components and the at least one sheath clamp may be subsequently pushed onto the cable sheath by the actuator device in a coherent processing sequence. Sequential fitting of the cable with the plug-in connector components and the sheath clamp or clamps, for example by respectively gripping and pushing-on each individual plug-in connector component or sheath clamp, is thus no longer necessary.

The plug-in connector components and sheath clamps may advantageously already be arranged in the desired sequence in the chambers of the fitting module.

A fitting module with individual chambers is advantageously suitable, in particular, for fully automated cable manufacture. The throughput of manufactured electric cables of a correspondingly configured device can thus be increased.

Furthermore, assembly errors or fitting errors can be avoided according to the invention, in particular if the chambers of the fitting module are designed to receive in each case only certain plug-in connector components or sheath clamps. Mixed-up fitting or fitting in the incorrect sequence or with the incorrect orientation can thus be avoided.

In an advantageous development of the invention, provision may be made for the fitting module to have a magazine in order to keep ready further plug-in connector components or further sheath clamps for fitting further cables.

It is thus advantageously possible to store the plug-in connector components and sheath clamps in magazines.

For example, a hopper-type magazine may be provided, the individual hoppers of said hopper-type magazine opening into the chambers of the fitting module, as a result of which the plug-in connector components or sheath clamps can be inserted from above in an ordered or unordered manner. A shaft-type magazine may preferably also be provided, in the case of which the individual plug-in connector components or sheath clamps lie one above the other and finally open into the chambers.

In principle, any desired types of magazine may be provided, for example also a roller conveyor-type magazine, a step-type magazine, a conveyor belt-type magazine, a sliding track-type magazine, a chain-type magazine, a lifting magazine or some other magazine, but in particular a magazine using gravitational force, in order to convey the individual plug-in connector components or sheath clamps as easily as possible into the chambers.

In an advantageous refinement of the invention, provision may be made for the chambers of the fitting module to be arranged in such a way that the plug-in connector components and sheath clamps received in the chambers are spaced apart from one another along the center axis at defined distances.

The plug-in connector components and sheath clamps may, however, also be arranged directly adjacent to one another. It may furthermore also be provided that individual plug-in connector components are arranged in the chambers having already been partially pushed one over the other or pre-assembled with one another.

The individual plug-in connector components and sheath clamps may optionally already be kept ready at the defined distances from one another provided later on the electric cable. For example, a distance may be provided between the plug-in connector components in order to be able to more easily grip or fit these in the subsequent manufacturing steps. In order to fix the plug-in connector components on the cable sheath at these defined positions, the sheath clamps may accordingly be fastened to the cable sheath adjacent to the plug-in connector components. In particular, a defined distance from a front, free end of the cable may also be provided in order to be able to process (for example to be able to strip insulation from) the front, free end in the course of cable manufacture, without damaging or having to displace the frontmost plug-in connector component.

In an advantageous refinement of the invention, provision may be made for the chambers of the fitting module to be formed in such a way that passage bores running through the plug-in connector components and the sheath clamps for receiving the cable are aligned coaxially with one another when the plug-in connector components and sheath clamps are received in the chambers.

Coaxial alignment of the passage bores of the plug-in connector components and sheath clamps may be advantageous, in particular, if the diameters of the passage bores correspond to, approximately correspond to, or are smaller than, the diameter of the cable sheath of the cable. In particular if the passage bores are relatively large with respect to the cable diameter, a coaxial alignment may optionally also be dispensed with.

In particular, it may also be advantageous if the plug-in connector components and/or the sheath clamps are blocked in a positively locking fashion in the push-in direction of the electric cable, so that they are not displaced from the cable as the electric cable is being led through.

In principle, provision may be made for chambers of the fitting module to be designed to fix the plug-in connector components and/or sheath clamps in a positively locking fashion and/or in a non-positively locking fashion in one, two, three, four, five or in all degrees of freedom.

In an advantageous refinement of the invention, a sensor device may be provided, which is configured to monitor the position of the cable along the center axis. For example, provision may be made for the position of the electric cable to be monitored as the electric cable is led through the plug-in connector components and sheath clamps. The monitoring may be performed throughout, or only in sections.

In an advantageous refinement of the invention, provision may be made for at least one of the plug-in connector components to be a shielding sleeve, a plug-in connector housing, a line seal, a cable retainer, a retaining cap or an angle cap.

As already mentioned at the outset, any desired plug-in connector components may be pushed onto the cable sheath of the electric cable and preferably held in position by means of the sheath clamps in the context of the invention. The plug-in connector components mentioned above are intended to be understood merely by way of example and may be provided particularly advantageously for fitting purposes in the context of the invention.

The shielding sleeve may also be referred to as a "ferrule" (or outer ferrule) and is generally provided in order to electromagnetically shield a contact parts carrier, in particular in the region of the contact elements of the electrical plug-in connector.

The contact parts carrier may be, in particular, a housing component of what will later be the electrical plug-in connector. The contact parts carrier may also be referred to as an inner housing or inner housing shell. The contact parts carrier generally has corresponding receptacles for receiving the contact element or the contact elements, which receptacles extend axially through the contact parts carrier. In this way, the inner conductors may be received in twist-proof fashion in the contact parts carrier. The contact parts carrier is preferably formed from a plastic.

For twist-proof fastening to the contact parts carrier, the contact parts carrier and the shielding sleeve may have a corresponding mechanical coding, for example a latching lug on the one hand and a corresponding latching groove on the other. The shielding sleeve may be pushed, for example, onto the contact parts carrier only with one specified orientation or with two orientations.

In the context of the invention, the shielding sleeve is preferably already pushed from the front onto the electric cable or onto its cable sheath in advance and, after fitting of the contact parts carrier, may be pushed over the contact parts carrier from the rear, that is to say starting from the cable sheath, or fastened in some other way to said contact parts carrier.

In particular if fitting between the shielding sleeve and the contact parts carrier has to take place with one or more defined alignments, it may be advantageous if at least that chamber of the fitting module which receives the shielding sleeve is designed to receive the shielding sleeve in a twist-proof and pre-aligned fashion.

The plug-in connector housing may be, in particular, a socket housing/plug housing (also referred to as an enclosing housing, outer housing or outer housing shell) which, in the course of manufacturing the electrical plug-in connector, is pushed on over the fitted shielding sleeve, for example from the rear, and fastened to the shielding sleeve. In particular, positionally correct locking to the shielding sleeve and/or to the contact parts carrier may be provided for this purpose, and for this reason twist-proof mounting within the corresponding chamber may be advantageous with regard to the plug-in connector housing too.

The line seal may be, in particular, a mechanical seal, for example a sealing ring for sealing against dirt, dust, liquids or gases, which may, for example, be pushed into a fitted plug-in connector housing from the rear. The diameter of the passage bore of the line seal may preferably be made somewhat smaller than the diameter of the cable sheath in order to improve the leaktightness. The line seal may have any desired cross-sectional geometry. Circular line seals are often used. It is however also possible for oval or polygonal, in particular rectangular, for example also square, line seals to be provided. A specific orientation is generally not of importance for fitting the line seal, in particular in the case of line seals with a circular cross-sectional geometry. If an oval or polygonal (for example rectangular) line seal is provided, a specified orientation relative to further plug-in connector components may however be important for the line seal too.

A cable retainer may be, in particular, a plug-in connector component that enables or supports absorption of tensile forces on the cable.

A terminating retaining cap—or in the case of an angled plug-in connector, an angle cap—may be a plug-in connector component that terminates the plug-in connector on the cable side and which, for example, fixes a cable retainer and/or a line seal in the plug-in connector, for example the plug-in connector housing. Provision may be made for the retaining cap or angle cap to have latching means in order to latch with the cable retainer and/or the plug-in connector housing. The retaining cap or angle cap may also be referred to as a terminating cap assembly.

The invention also relates to a sheath clamp for reversible fastening to a cable sheath of an electric cable in the course of manufacturing the electric cable in mutually independent processing modules. The sheath clamp may be independent of the plug-in connector to be fitted on the cable in the course of the manufacturing process. The sheath clamp is therefore preferably not a plug-in connector component which will later be part of the plug-in connector.

According to the invention, plug-in connector components may be held in position on the cable sheath of the cable by means of the at least one sheath clamp.

Furthermore, the sheath clamp may be highly suitable for identifying the cable in the course of manufacturing the electric cable.

The invention also relates to a device for manufacturing an electric cable. The device has a fitting module which is designed to fasten a sheath clamp, which is independent of the plug-in connector to be fitted on the cable in the course of the manufacturing process, to a cable sheath of the cable in a non-positively locking fashion at a defined axial position along the longitudinal axis of the cable. As an alternative or in addition to the fitting module, the device has a cable carrier to which the cable can be fastened. The cable carrier has at least one stop element which is arranged at a defined position along the longitudinal axis of the cable.

In addition, the device may be designed to remove the sheath clamp(s) from the cable again after processing by at least one of the processing modules.

The electric cable may be formed, for example, as a high-voltage line.

Provision may be made for the method described above to be carried out using said device.

The invention also relates to a cable carrier for receiving an electric cable to be manufactured. The cable carrier has at least one stop element which is arranged at a defined axial position along the longitudinal axis of the cable fastened in the cable carrier, in order to block the displacement path of plug-in connector components on the cable sheath in a positively locking fashion.

The invention also relates to a system for manufacturing an electric cable, in particular a high-voltage line. The system comprises a device for manufacturing an electric cable, according to the disclosures herein. The system further comprises at least two mutually independent processing modules for manufacturing the electric cable.

The distribution according to the invention of the processing steps across multiple mutually independent modules makes it possible to operate the system as an "assembly line process" or as a "cycle machine" with successive individual steps, in order to reduce the processing time for mass processing.

The device or the individual processing modules may further be of modular construction, as a result of which individual processing modules of the assembly can be replaced, modified or removed without a great deal of effort. In this way, the system may be configurable with simple means, in particular for processing different types of cable.

The independent processing modules may preferably be arranged upstream of or downstream of the device.

According to a development of the invention, provision may be made for at least one of the processing modules to be formed as a processing module for stripping insulation from a portion of a cable component of the cable and/or to be formed as a processing module for fitting the electric cable with a plug-in connector component of a plug-in connector to be fitted on the electric cable, and/or to be formed as a processing module for ensuring the cable sheath is correctly fitted with the plug-in connector components and/or to be formed as a processing module for fitting a plug-in connector component of an electrical plug-in connector.

Yet further processing modules, which are independent of one another, and of the device, and are arranged upstream or downstream of the device may also be provided.

Features that have been described in conjunction with the method according to the invention may self-evidently also be advantageously implemented for the device, the sheath clamp, the cable carrier and the system—and vice versa. Furthermore, advantages that have already been mentioned in conjunction with the method according to the invention can also be understood as relating to the device, the sheath clamp, the cable carrier or the system—and vice versa.

In addition, it should be noted that expressions such as "comprising", "having" or "with" do not exclude any other features or steps. Furthermore, expressions such as "a" or "the" that refer in the singular to steps or features do not exclude multiple features or steps—and vice versa.

It is furthermore emphasized that the values and parameters described herein also encompass deviations or fluctuations of ±10% or less, preferably ±5% or less, more preferably ±1% or less, and very particularly preferably ±0.1% or less, of the respectively stated value or parameter, if such deviations are not ruled out in practice in the implementation of the invention. The specification of ranges by way of start and end values also encompasses all values and fractions encompassed by the respectively stated range, in particular the start and end values and a respective mean value.

Exemplary embodiments of the invention are described herein with reference to the accompanying Figures which also provide the disclosures of the present invention.

The Figures each show preferred exemplary embodiments in which individual features of the present invention are illustrated in combination with one another. Features of one exemplary embodiment may also be implemented separately from the other features of the same exemplary embodiment, and may accordingly be readily combined by an expert to form further useful combinations and sub-combinations with features of other exemplary embodiments.

Elements of identical function are denoted by the same reference signs in the Figures.

SUMMARY

Our method, device and system for manufacturing an electrical cable generally provides a method for manufacturing an electric cable (2), according to which the electric cable (2) is successively processed in processing modules (41, 43) that are independent from one anther. At least one sheath clamp (10.1, 10.2, 10.3, 10.4), which is independent from the plug connectors (22) that are to be mounted on the cable (2) during manufacturing, is attached to cable sheath (9) of the cable (2) in a non-positive fit at a defined axial position along the longitudinal axis (L) of the cable (2). Alternatively, or in addition, the cable (2) is attached to a cable carrier (4), wherein the cable carrier (4) comprises at least one stop element (44) which is arranged at a defined axial position along the longitudinal axis (L) of the cable (2).

A principal aspect of the present invention is a method for manufacturing an electric cable (2), according to which method the cable (2) is processed in mutually independent processing modules (41, 43) in succession, characterized in that at least one sheath clamp (10.1, 10.2, 10.3, 10.4), which is independent of the plug-in connector (22) to be fitted on the cable (2) in the course of the manufacturing process, is fastened to a cable sheath (9) of the cable (2) in a non-positively locking fashion at a defined axial position along the longitudinal axis (L) of the cable (2); and/or the cable (2) is fastened to a cable carrier (4), wherein the cable carrier (4) has at least one stop element (44) which is arranged at a defined axial position along the longitudinal axis (L) of the cable (2).

A further aspect of the present invention is a method, characterized in that the sheath clamp (10.1, 10.2, 10.3, 10.4) is pushed onto the cable sheath (9) of the cable (2) starting from a front, free end (6, 7) of the cable (2) until the defined axial position is reached.

A further aspect of the present invention is a method, characterized in that the sheath clamp (10.1, 10.2, 10.3, 10.4) is attached to the cable sheath (9) of the cable (2) at a defined axial position radially in the direction of the center axis (M) of the cable (2).

A further aspect of the present invention is a method, characterized in that the at least one sheath clamp (10.1, 10.2, 10.3, 10.4) is remove from the cable sheath (9) of the cable (2) again after processing by at least one of the processing modules (41, 43), preferably after processing by all of the processing modules (41, 43).

A further aspect of the present invention is a method, characterized in that the sheath clamp (10.1, 10.2, 10.3, 10.4) is made identifiable by way of an information carrier (11.1, 11.2) in order to be able to uniquely identify the cable (2) while it is being processed.

A further aspect of the present invention is a method, characterized in that documentation (13) of the processing of the cable (2) is compiled for at least one processing process of one of the processing modules (41, 43) and is assigned to the sheath clamp (10.1, 10.2, 10.3, 10.4) which is fastened to the cable (2).

A further aspect of the present invention is a method, characterized in that the documentation (13) is at least partially imprinted into the information carrier (11.1, 11.2) of the sheath clamp (10.1, 10.2, 10.3, 10.4).

A further aspect of the present invention is a method, characterized in that a unique identifier (14) for the cable (2) is imprinted into the information carrier (11.1, 11.2) or a unique identifier (14) which is already present on the information carrier (11.1, 11.2) is assigned to the cable (2).

A further aspect of the present invention is a method, characterized in that the information carrier (11.1, 11.2) is of optical form and/or electronic form.

A further aspect of the present invention is a method, characterized in that the optical information carrier (11.1) is formed as a barcode, numerical code and/or 2D code, for example a data matrix code or QR code.

A further aspect of the present invention is a method, characterized in that the electronic information carrier (11.2) comprises at least one programmable memory module, for example an RFID transponder, which is modified to identify the cable (2) and/or to document the processing of the cable (2).

A further aspect of the present invention is a method, characterized in that the cable sheath (9) of the cable (2) is fitted with one or more plug-in connector components (24, 25, 26, 27, 28) for later plug-in connector fitting starting from the front, free end (6, 7) of the cable (2).

A further aspect of the present invention is a method, characterized in that the at least one sheath clamp (10.1, 10.2, 10.3, 10.4) is arranged axially adjacent to the at least one plug-in connector component (24, 25, 26, 27, 28) on the cable sheath (9) in order to block the displacement path of the plug-in connector component (24, 25, 26, 27, 28) on the cable sheath (9) in a positively locking fashion.

A further aspect of the present invention is a method, characterized in that the at least one stop element (44) of the cable carrier (4) is arranged axially adjacent to the at least one plug-in connector component (24, 25, 26, 27, 28) along the longitudinal axis (L) of the cable (2) in order to block the displacement path of the plug-in connector component (24, 25, 26, 27, 28) on the cable sheath (9) in a positively locking fashion.

A further aspect of the present invention is a method, characterized in that a fitting module (33) with individual chambers (34) for receiving plug-in connector components (24, 25, 26, 27, 28) and sheath clamps (10.1, 10.2, 10.3, 10.4) is provided, which individual chambers are arranged in such a way that the plug-in connector components (24, 25, 26, 27, 28) and sheath clamps (10.1, 10.2, 10.3, 10.4) which are received in the chambers (34) form a common channel (K) with a common center axis (M), and wherein an actuator device (37) is provided and designed to conduct the cable (2), by way of its front end (6, 7), along the center axis (M) through the plug-in connector components (24, 25, 26, 27, 28) and the sheath clamps (10.1, 10.2, 10.3, 10.4) in order to push the plug-in connector components (24, 25, 26, 27, 28) and the sheath clamps (10.1, 10.2, 10.3, 10.4) axially onto the cable sheath (9) of the cable (2).

A further aspect of the present invention is a method, characterized in that the fitting module (33) has a magazine (35) in order to keep ready further plug-in connector components (24, 25, 26, 27, 28) or further sheath clamps (10.1, 10.2, 10.3, 10.4) for fitting further cables (2).

A further aspect of the present invention is a sheath clamp (10.1, 10.2, 10.3, 10.4) for reversible fastening to a cable sheath (9) of an electric cable (2) in the course of manufacturing the electric cable (2) in mutually independent processing modules (41, 43).

A further aspect of the present invention is a device (1) for manufacturing an electric cable (2), characterized in that a fitting module (33) is provided and designed to fasten a sheath clamp (10.1, 10.2, 10.3, 10.4), which is independent of the plug-in connector (22) to be fitted on the cable (2) in the course of the manufacturing process, to a cable sheath (9) of the cable (2) in a non-positively locking fashion at a defined axial position along the longitudinal axis (L) of the cable (2); and/or a cable carrier (4) is provided, to which the cable (2) can be fastened, wherein the cable carrier (4) has at least one stop element (44) which is arranged at a defined axial position along the longitudinal axis (L) of the cable (2).

A further aspect of the present invention is a cable carrier (4) for receiving an electric cable (2) to be manufactured, characterized in that the cable carrier (4) has at least one stop element (44) which is arranged at a defined axial position along the longitudinal axis (L) of the cable (2) fastened in the cable carrier (4), in order to block the displacement path of plug-in connector components (24, 25, 26, 27, 28) on the cable sheath (9) in a positively locking fashion.

A still further aspect of the present invention is a system (40) for manufacturing an electric cable (2), comprising a) a device (1) for manufacturing the electric cable (2) as claimed in claim 18; and b) at least two mutually independent processing modules (41, 43) for manufacturing the electric cable (2).

An even still further aspect of the present invention is a system (40), characterized in that at least one of the processing modules (41, 43) is formed as a processing module for stripping insulation from a portion of a cable component of the cable (2) and/or is formed as a processing module for fitting the electric cable (2) with a plug-in connector component (24, 25, 26, 27, 28) of a plug-in connector (22) to be fitted on the electric cable (2) and/or is formed as a processing module for ensuring the cable sheath (9) is correctly fitted with the plug-in connector components (24, 25, 26, 27, 28) and/or is formed as a processing module for fitting a plug-in connector component (24, 25, 26, 27, 28) of an electrical plug-in connector (22)

These and other aspects of the present invention are more fully set forth herein.

BRIEF DESCRIPTIONS OF THE FIGURES

In the Figures, in each case schematically:

DETAILED WRITTEN DESCRIPTION OF THE PREFERRED EMBODIMENTS

This disclosure of the invention is submitted in furtherance of the Constitutional purposes of the US Patent Laws "to promote the progress of Science and the useful arts" (Article 1, Section 8).

Figure 1:
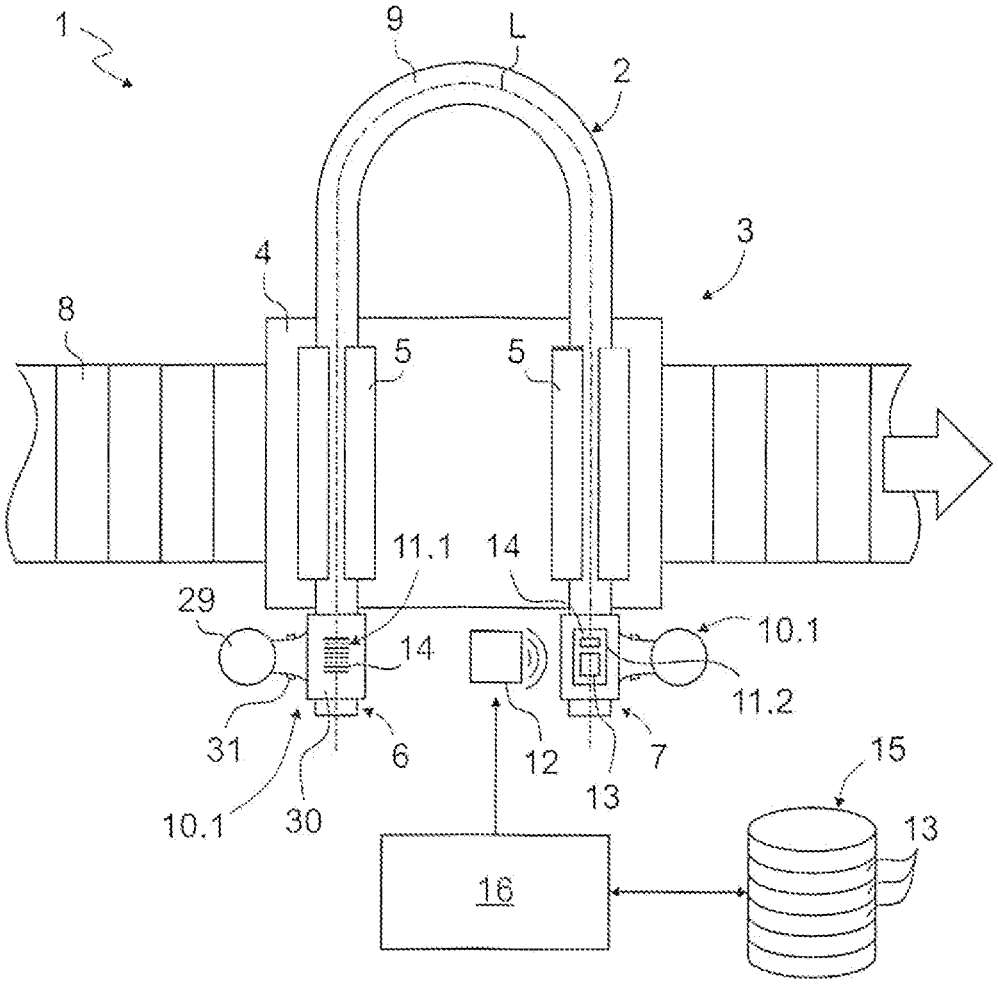
FIG. 1 shows an electric cable fastened to a cable carrier with two sheath clamps fastened to the cable sheath.
Figure 8:
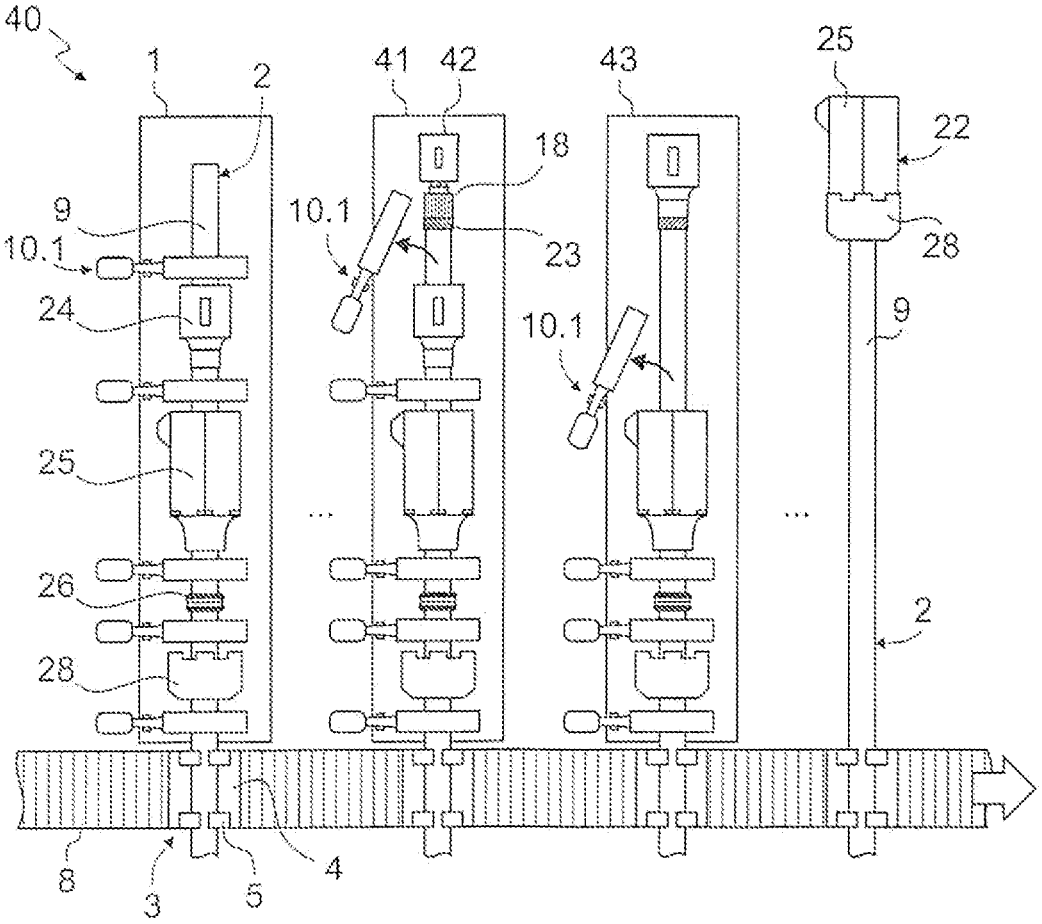
FIG. 8 shows a system for manufacturing an electric cable with a device for manufacturing the electric cable and with at least two mutually independent processing modules.

FIG. 1 shows a device 1 for manufacturing an electric cable 2 in the course of processing the cable 2 in mutually independent processing modules 41, 43 (cf. FIG. 8).

A workpiece carrier system 3 is provided, which has a cable carrier 4 to which the electric cable 2 is fastened. The electric cable 2 can therefore be assigned to the cable carrier 4 as it is being processed throughout the manufacturing process or during part of the manufacturing process, for example during processing by one of the independent processing modules 41, 43. It should be noted that, in principle, a plurality of cable carriers 4 may also be provided, which are each assigned to different processing modules 41, 43 (however, for reasons of simplicity, this variant is not illustrated in the exemplary embodiments). For example, a first cable carrier may transport the cable 2 between processing modules of a first group of processing modules and a second cable carrier may transport the cable 2 between processing modules of a second group of processing modules. Even more cable carriers 4 and assigned processing modules may also be provided, wherein even one single cable carrier 4 for each processing module 41, 43 is possible. In principle, the cable 2 may also be fastened to an immovable cable carrier 4, for example if, on the contrary, a tool carrier system feeds one or more tools of the processing modules 41, 43 or the processing modules 41, 43 to the cable 2. The cable 2 may be transferred between individual cable carriers 4, for example by means of a gripping device or some other transportation device, preferably with a known or unchanged alignment or orientation.

The cable carrier 4 has clamping jaws 5 in order to fix the first cable end 6 and/or the second cable end 7 of the cable 2, in the exemplary embodiment both cable ends 6, 7. In the exemplary embodiment, the cable 2 is clamped into the cable carrier 4 in such a way that a U-shaped profile is formed between the two cable ends 6, 7. In principle, a profile deviating from this may also be provided, for example a helical winding in the case of a relatively long cable 2. Provision may also be made for only one of the two cable ends 6, 7 to be received in the cable carrier 4. The actual configuration of the cable carrier 4 and the manner of fastening of the cable 2 on the cable carrier 4 are not of importance in the context of the invention.

In order to transport the cable 2 between the independent processing modules 41, 43 for processing said cable, the cable carrier 4 is fitted, by way of example, on a transportation device 8 in the form of a conveyor belt. In principle, however, the cable 2 may be moved between the processing modules 41, 43 in any desired manner, for example including by a production technician using a roller track.

In the context of the invention, provision is made for at least one sheath clamp 10.1, 10.2, 10.3, 10.4 to be fastened to a cable sheath 9 of the cable 2 in a non-positively locking fashion at a defined axial position along the longitudinal axis L of the cable 2. Two sheath clamps 10.1 (one sheath clamp 10.1 at each cable end 6, 7) are illustrated by way of example in FIG. 1. The sheath clamp 10.1, 10.2, 10.3, 10.4 is not part of what will later be the plug-in connector.

Provision may be made for the sheath clamps 10.1, 10.2, 10.3, 10.4 to be made identifiable by an information carrier 11.1, 11.2 in order to be able to uniquely identify the cable 2 while it is being processed. By way of example, an optical information carrier 11.1 is illustrated on the sheath clamp 10.1 assigned to the first cable end 6, and an electronic information carrier 11.2 is illustrated on the sheath clamp 10.1 assigned to the second cable end 7.

The optical information carrier 11.1 is illustrated, by way of example, as a barcode. However, the optical information carrier 11.1 may also be, for example, and without limitation, a numerical code and/or 2D code, for example a data matrix code or a QR code.

In the context of the invention, the information carrier 11.1, 11.2 may be applied to the sheath clamp 10.1, 10.2, 10.3, 10.4, for example by means of a laser, not illustrated. Provision may also be made to modify an existing information carrier 11.1, 11.2, for example a serial number already printed on the sheath clamp 10.1, 10.2, 10.3, 10.4 or an existing barcode. Instead of a laser, any desired device for applying and/or modifying an optical information carrier 11.1, for example even an inkjet printer, may be provided in principle.

The electronic information carrier 11.2 may be, for example, at least one programmable memory module, for example only, and without limitation, an RFID transponder, which can be modified to identify the cable 2 and/or to document the processing of the cable 2. For example, a read/write device 12 for communicating with the RFID transponder 11.2 is illustrated in FIG. 1.

Provision may be made for documentation 13 of the processing of the cable 2 to be compiled for at least one processing process of one of the processing modules 41, 43 and to be assigned to the cable 2.

For this purpose, for example, a unique identifier 14 for the cable 2 may be imprinted into the information carrier 11.1, 11.2 and/or a unique identifier 14 that has already been imprinted on the information carrier 11.1, 11.2 is temporarily assigned to the cable 2 for manufacturing said cable.

The identifier 14 may be, for example only, and without limitation, a binary, decimal or hexadecimal numerical value or a numerical sequence. The identifier 14 may be encoded or imprinted, for example, in the barcode or some other code. The identifier 14 may also be imprinted or stored in an electronic component, for example a memory module, for example in the RFID transponder 11.2.

For example, provision may also be made for different sheath clamps 10.1, 10.2, 10.3, 10.4 to already have a respective information carrier 11.1, 11.2 with a respectively unique identifier 14. Owing to the fastening of the sheath clamps 10.1, 10.2, 10.3, 10.4 to the cable 2 during the manufacture or at least during a sub-process of the manufacture, the documentation 13 can ultimately be assigned. However, provision may also be made, for example, for the information carrier 11.1, 11.2 to be provided in a targeted fashion with an identifier 14 for the identification of the cable 2 for the manufacturing process to be documented.

Provision may be made for the documentation 13 to be at least partially imprinted into the information carrier 11.1, 11.2. This may be advantageous in particular when the information carrier 11.1, 11.2 is an electronic information carrier 11.2 on which sufficient storage space is available (indicated in FIG. 1). However, provision may also be made, for example, for a continuous numerical sequence or a similar code to be provided in order to record the documentation 13 continuously in the course of the cable manufacture, for example in optical form on the sheath clamp 10.1, 10.2, 10.3, 10.4.

For example, one, some or all of the processing modules 41, 43 may have a read/write unit 12 and/or a scanner for reading out a barcode (or some other code) and/or a laser or a printer in order to augment the documentation 13 or to evaluate said documentation for the cable processing operation.

However, a global database 15 may preferably be used, in which documentation 13 compiled in the course of the manufacture production line may be assigned to individual cables 2, preferably on the basis of the respective unique identifier 14. The addressing in the database 15 may thus be implemented in a manner dependent on the identifier 14 of the respective cable 2.

A control unit 16 may be provided in the context of the device 1 according to the invention for manufacture in order to carry out the described method. The control unit 16 may be communicatively connected, for example, to the devices for imprinting and/or reading out and/or modifying the information carrier 11.1, 11.2 (indicated with regard to the read/write unit 12) and may furthermore be communicatively connected to the database 15.

For example, information relating to a successful processing process, an incorrect processing process, a failed processing process and/or at least one process parameter of the processing process may be recorded in the documentation 13. The documentation 13 may be used in the context of quality management. In the context of quality management, provision may for example be made to sort the cable 2 or to approve it for post-processing in a manner dependent on the information contained in the documentation 13. In particular, removal of an incorrectly processed cable 2 may be provided in the context of quality management.

The information for the documentation 13 may be recorded by the control unit 16 using a communication interface, for example. For example, the control unit 16 may be communicatively connected to the individual processing modules 41, 43 via a respective communication interface in order to obtain information relating to the processing processes from the respective processing modules 41, 43 and record said information in the documentation 13.

Figure 2:
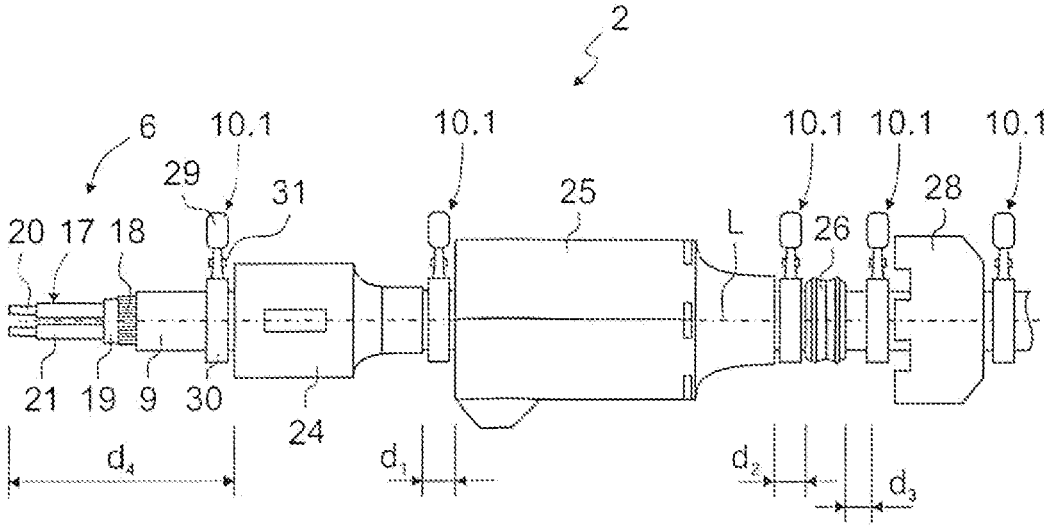
FIG. 2 shows an orthographic side view of an exemplary two-core electric cable fitted with four plug-in connector components and a plurality of sheath clamps.

FIG. 2 illustrates an enlarged side view of an exemplary multicore electric cable 2.

The inner conductors 17 of the cable 2 extend from the first cable end 6 to the second cable end 7 (not illustrated in FIG. 2). In the present case, the first cable end 6 is referred to as a front, free end of the cable 2.

The multicore electric cable 2 has already been partially processed at its front end 6. However, in general, the plug-in connector components 24, 25, 26, 27, 28 described further herein are pushed onto an unprocessed cable end 6, 7. In particular, for better illustration of possible constituent parts of the electric cable 2, the front, free end 6 of the cable in FIG. 2 is however already stripped of insulation in regions in the present case. This also applies to the single-core cable 2 in FIG. 3.

The two-core cable 2 has a cable shielding braid 18 running underneath the cable sheath 9. A shielding foil or film may optionally run above the cable shielding braid 18 (not illustrated). The two inner conductors 17 run within a filler layer 19 below the cable shielding braid 18. The electrical conductors 20 or cores of the inner conductors 17 are each encased by an insulation 21. In the course of cable manufacture, the electrical conductors 20 of the inner conductors 17 may be exposed in the region of the inner conductor ends, as illustrated. Inner conductor contact elements (not illustrated) of an electrical plug-in connector 22 (cf. FIG. 8) may then be fastened, in particular crimped, to the respective inner conductor ends. In the course of the cable manufacture, the cable shielding braid 18 may be folded back over the cable sheath 9, preferably over a metal sleeve or supporting sleeve, not illustrated, and optionally fixed to a fabric tape 23 (cf. FIG. 8).

The two-core cable 2 illustrated in FIG. 2 is to be understood merely by way of example for use with the invention. In principle, the invention is suitable for use with any desired type of cable, for example also including for use with an electric cable 2 having just one inner conductor 17, for example of coaxial design, as illustrated in FIG. 3.

Figure 3:
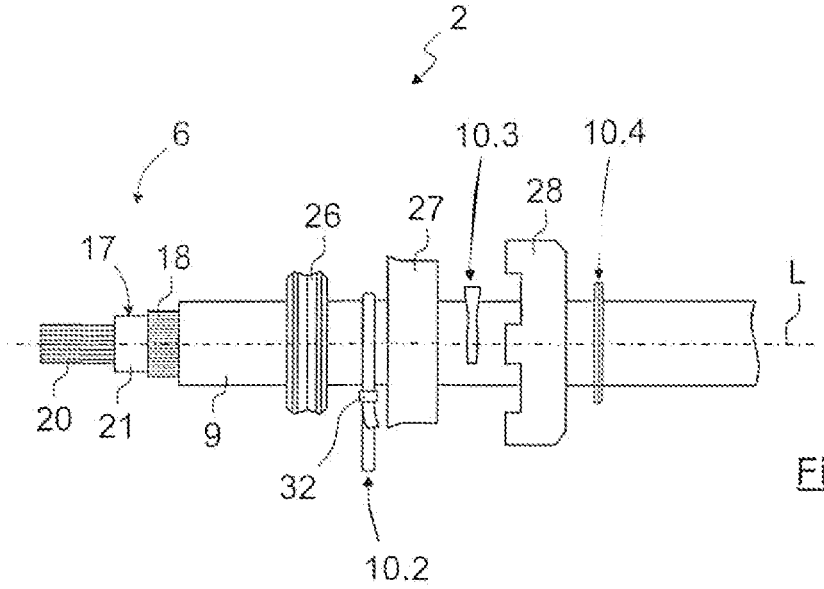
FIG. 3 shows an orthographic side view of an exemplary single-core electric cable fitted with three plug-in connector components and a plurality of sheath clamps.

FIG. 3 shows the front, free end 6 of a single-core electric cable 2 that has already been partially stripped of insulation. The single-core cable 2 likewise has a cable sheath 9 and a cable shielding braid 18 running underneath the cable sheath 9. The cable shielding braid 18 may likewise be folded over onto a supporting sleeve, not illustrated. The insulation 21 or the primary insulation of the inner conductor 17 runs underneath the cable shielding braid 18. The electrical conductor 20 of the inner conductor 17 may be formed, for example, as a stranded wire comprising several individual wires, as indicated in FIG. 3. In principle, however, the exact structure of the single-core cable 2 is not of importance.

In the course of manufacturing the electric cable 2, provision may be made to fit the cable sheath 9 of the cable 2 with two or more plug-in connector components 24, 25, 26, 27, 28 for plug-in connector fitting starting from one of the cable ends 6, 7 of the cable 2. These plug-in connector components may be, for example, a shielding sleeve 24 (cf. FIG. 2), a plug-in connector housing 25 (cf. FIG. 2), a line seal 26 (cf. FIG. 2 or FIG. 3), a cable retainer 27 (cf. FIG. 3), a retaining cap or closure cap 28 (cf. FIG. 2 or FIG. 3) or an angle cap. In principle, the configuration of the plug-in connector component is not of importance in the context of the invention. The invention is suitable for fitting a single-core or multicore electric cable 2 with any desired plug-in connector components 24, 25, 26, 27, 28.

In the course of manufacturing a two-core or multicore electric cable 2, it may however be the case in particular that fitting in accordance with the sequence, illustrated in FIG. 2, of a shielding sleeve 24, followed by a socket housing or a plug-in connector housing 25, followed by a line seal 26, followed by a retaining cap 28 (or an angle cap in the case of an angled plug-in connector) is highly suitable. In the case of manufacturing a single-core electric cable 2, fitting in accordance with FIG. 3, whereby a line seal 26, followed by a cable retainer 27, followed by a retaining cap 28 are pushed onto the cable sheath 9 starting from the front end 6 of the cable 2, may preferably be highly suitable.

As an alternative or in addition, besides making the cable 2 identifiable, the abovementioned sheath clamps 10.1, 10.2, 10.3, 10.4 may also be suitable for holding the plug-in connector components 24, 25, 26, 27, 28 attached to the cable sheath 9 of the cable 2 in the course of fitting at the desired axial positions along the center axis or longitudinal axis L of the cable 2. For this purpose, the sheath clamps 10.1, 10.2, 10.3, 10.4 may be attached to the cable sheath 9 of the cable 2 at the respectively intended defined axial positions radially in the direction of the center axis or longitudinal axis L of the cable 2. By way of example, a few sheath clamps 10.1, 10.2, 10.3, 10.4 of different types are illustrated in FIGS. 2 and 3.

In principle, it may be advantageous to surround each of the plug-in connector components 24, 25, 26, 27, 28 with two sheath clamps 10.1, 10.2, 10.3, 10.4 in order to prevent undesired displacement of the plug-in connector component 24, 25, 26, 27, 28 in both directions along the longitudinal axis L of the cable 2. Depending on the plug-in connector component 24, 25, 26, 27, 28, the need for this may, however, also be dispensed with, for example if the plug-in connector component 24, 25, 26, 27, 28 is a seal, for example a line seal 26, which is generally already clamped sufficiently firmly on the cable sheath 9 of the cable 2.

In principle, different types of sheath clamps 10.1, 10.2, 10.3, 10.4 may be provided. For example, the clamps 10.1 illustrated in FIGS. 1 and 2 may be provided, these having an actuation region 29 and a fastening region 30. By means of the actuation region 29, the clamping jaws which are situated at the opposite end of two clamping limbs and which form the fastening region 30 can be opened counter to the spring force of a resetting spring 31, and the sheath clamp 10.1 may thus be radially attached to the cable 2. As an alternative, however, sheath clamps 10.2 with lashing elements 32 in the form of a cable tie (cf. FIG. 3) may also be provided. A further exemplary sheath clamp 10.3, which has a metallic partial ring that can be clamped on the cable sheath 9, is likewise illustrated in FIG. 3. Furthermore, FIG. 3 shows a further exemplary sheath clamp 10.4 which has an elastic ring, for example a rubber ring, similar to a sealing ring. The exact design of the sheath clamp 10.1, 10.2, 10.3, 10.4 is not of absolute importance in the context of the invention. The sheath clamps 10.1, 10.2, 10.3, 10.4 are preferably fastened in a non-positively locking and reversible fashion to the cable sheath 9 of the cable 2.

The at least one sheath clamp 10.1, 10.2, 10.3, 10.4 may be removed from the cable sheath 9 of the cable 2 again after processing by at least one of the processing modules 41, 43, preferably after processing by all of the processing modules 41, 43 (after complete manufacture of the electric cable 2).

Figure 4:
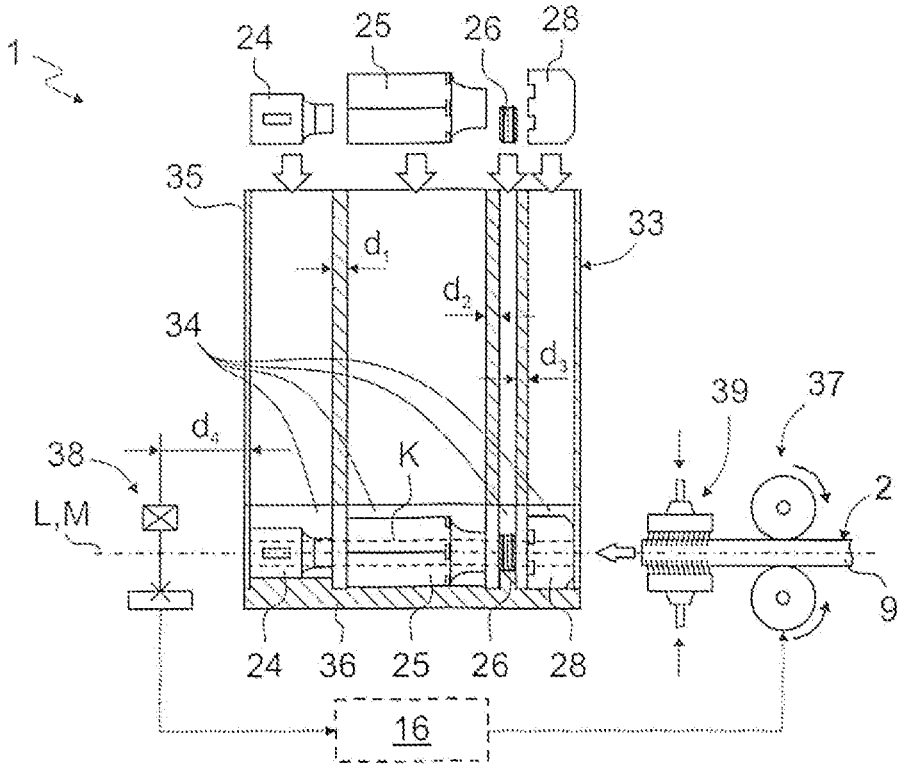
FIG. 4 shows a sectional side view illustration of a fitting module with an actuator device.

FIG. 4 schematically illustrates a sectional side illustration of a fitting module 33 with individual chambers 34 for receiving plug-in connector components 24, 25, 26, 27, 28. The fitting module 33 is designed in order to fit the cable sheath 9 of the cable 2 with two or more plug-in connector components 24, 25, 26, 27, 28 for later plug-in connector fitting starting from one of the two cable ends 6, 7. The fitting module 33 for fitting the two-core cable 2 according to FIG. 2 is illustrated merely by way of example.

In addition, the fitting module 33 may be designed to receive one or more sheath clamps 10.1, 10.2, 10.3, 10.4 in a respective chamber 34 in order to also push the sheath clamp(s) 10.1, 10.2, 10.3, 10.4 onto the cable sheath 9 of the cable 2 starting from the free cable end 6, 7 of the cable 2 until the defined axial position is reached. However, this is not shown in FIG. 4 for reasons of simplifying the illustration. However, in principle, the sheath clamps 10.1, 10.2, 10.3, 10.4 may be handled in the fitting module 33, like the plug-in connector components 24, 25, 26, 27, 28.

It should be noted that the sheath clamps 10.1, 10.2, 10.3, 10.4 may also be axially pushed onto the front, free end 6, 7 of the cable sheath 9, without a fitting module 33 of the illustrated form being used. In principle, a device 1 for manufacturing the electric cable 2 may have any desired fitting module for non-positively fastening a sheath clamp 10.1, 10.2, 10.3, 10.4 to the cable sheath 9 of the cable 2.

The chambers 34 are arranged in such a way that the plug-in connector components 24, 25, 26, 27, 28 (and/or sheath clamps 10.1, 10.2, 10.3, 10.4) received in the chambers 34 form a common channel K (cf. illustration using dashed lines in FIG. 4) with a common center axis M.

As illustrated in the exemplary embodiment, the fitting module 33 may have a magazine 35 in order to keep ready the plug-in connector components 24, 25, 26, 27, 28 (and/or sheath clamps 10.1, 10.2, 10.3, 10.4) for fitting further cables 2. In the exemplary embodiment, a shaft-type magazine is illustrated; in principle, however, any desired magazine may be provided.

The chambers 34 of the fitting module 33 may be arranged in such a way that the plug-in connector components 24, 25, 26, 27, 28 (and/or sheath clamps 10.1, 10.2, 10.3, 10.4) received in the chambers 34 are spaced apart from one another along the center axis M at defined distances $d_1$, $d_2$, $d_3$, $d_4$. Depending on the respective plug-in connector component 24, 25, 26, 27, 28 and the subsequent fitting process, provision may be made for different plug-in connector components 24, 25, 26, 27, 28 to be spaced apart from one another by different distances $d_1$, $d_2$, $d_3$, $d_4$ which may be specified, for example, by a corresponding wall thickness of the chambers 34 and/or of the magazine 35.

For example, a first distance $d_1$ may be provided between the frontmost plug-in connector component (in the exemplary embodiment, the shielding sleeve 24) and the second plug-in connector component (in the exemplary embodiment, the plug-in connector housing 25), a second distance $d_2$ may be provided between the second plug-in connector component or the plug-in connector housing 25 and a third plug-in connector component (in the exemplary embodiment, the line seal 26) and a third distance $d_3$ may be provided between the third plug-in connector component or the line seal 26 and a fourth plug-in connector component (in the exemplary embodiment, the retaining cap 28). A defined distance $d_4$ between the first plug-in connector component or the shielding sleeve 24 and the cable end 6, 7 of the cable 2 may also be provided when the electric cable 2 has been fully pushed into the fitting module 33. The distances $d_1$, $d_2$, $d_3$, $d_4$ are ultimately reproduced on the fitted cable (cf. FIG. 2). In order that the distances $d_1$, $d_2$, $d_3$, $d_4$ are maintained, in particular in the event of handling of the cable 2 during manufacture, for example in the event of transportation between the individual processing modules 41, 43, and also plug-in connector components 24, 25, 26, 27, 28 do not become lost or slide one into the other, the sheath clamps 10.1, 10.2, 10.3, 10.4 may be fastened between the plug-in connector components 24, 25, 26, 27, 28.

Advantageously, the chambers 34 of the fitting module 33 may also be designed in such a way that passage bores which run through the plug-in connector components 24, 25, 26, 27, 28 (and/or sheath clamps 10.1, 10.2, 10.3, 10.4) and which serve for receiving the cable 2 are aligned coaxially with one another when the plug-in connector components 24, 25, 26, 27, 28 (and/or sheath clamps 10.1, 10.2, 10.3, 10.4) have been received in the chambers 34. For this purpose, for example, the support surface or a lower base 36 of the fitting module 33 in the respective chambers 34 may have a depth respectively configured for the plug-in connector component 24, 25, 26, 27, 28 (and/or sheath clamp 10.1, 10.2, 10.3, 10.4), as illustrated in FIG. 4. In addition, provision may be made for the chambers 34 of the fitting module 33 to be designed to hold the plug-in connector components 24, 25, 26, 27, 28 (and/or sheath clamps 10.1, 10.2, 10.3, 10.4) in twist-proof fashion, in particular if a specific alignment or orientation of individual plug-in connector components 24, 25, 26, 27, 28 is provided in the course of the subsequent manufacture of the electric cable 2.

Figure 5:
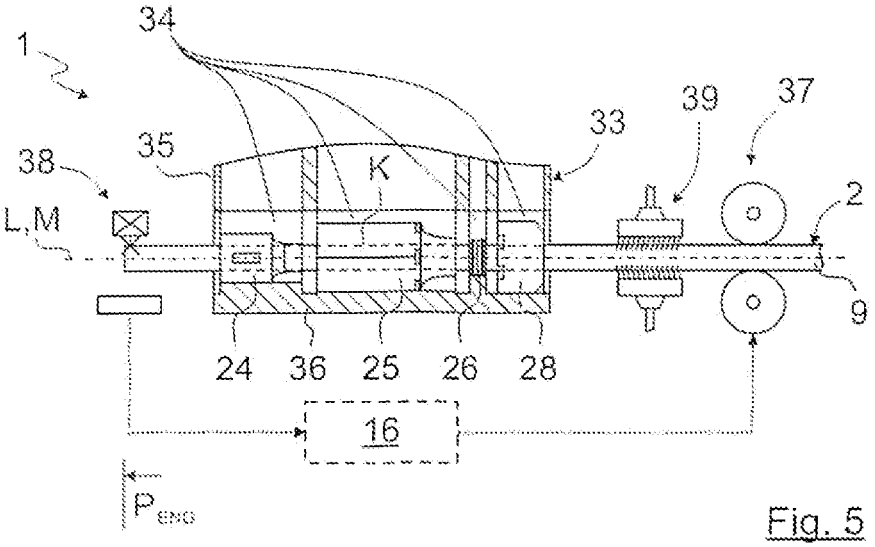
FIG. 5 shows a detail view of the fitting module of FIG. 4 after leading the electric cable through the plug-in connector components.

The fitting module 33 further has an actuator device 37 which is designed to conduct the cable 2, by way of its front end 6, 7, along the center axis M through the plug-in connector components 24, 25, 26, 27, 28 (and/or sheath clamps 10.1, 10.2, 10.3, 10.4) in order to push the plug-in connector components 24, 25, 26, 27, 28 (and/or sheath clamps 10.1, 10.2, 10.3, 10.4) onto the cable sheath 9 of the cable 2. As an alternative to an actuator device 37, the cable 2 may also be manually transported by a production technician. The cable 2 may thus be led, by way of its front end 6, 7, along the center axis M through the plug-in connector components 24, 25, 26, 27, 28 (and/or sheath clamps 10.1, 10.2, 10.3, 10.4) until it reaches a predetermined end position $P_{END}$, as illustrated in FIG. 5. In the exemplary embodiment, the actuator device 37 has a roller conveyor device with two rollers, between which the cable 2 is guided in order to linearly displace said cable.

In order to monitor the position of the cable 2 along the center axis M, a sensor device 38 may be provided. In the exemplary embodiment, a light barrier is illustrated by way of example in order to identify when the electric cable 2 has reached the end position $P_{END}$ in the fitting module 33 and to stop the cable feed (cf. FIGS. 4 and 5). It may also be possible for yet further light barriers or other sensors to be provided in order to detect yet further discrete positions of the cable 2. In principle, continuous detection of the position of the cable 2 or its front, free end 6, 7 may also be provided in addition or as an alternative to detecting one or more discrete positions.

In particular, in order to prevent the plug-in connector components 24, 25, 26, 27, 28 (and/or sheath clamps 10.1, 10.2, 10.3, 10.4) from being displaced along the center axis M while the electric cable 2 is being led through, provision may be made for the chambers 34 of the fitting module 33 to be designed to block the plug-in connector components 24, 25, 26, 27, 28 (and/or sheath clamps 10.1, 10.2, 10.3, 10.4) in the axial direction, in particular in the push-in direction (cf. arrow in FIG. 4) of the electric cable 2, along the center axis M in a positively locking fashion. For this purpose, it is possible, for example, for the walls of the magazine 35 to be continued, wherein a corresponding opening can allow the cable 2 to be led through.

In particular if the passage bores of the plug-in connector components 24, 25, 26, 27, 28 correspond or at least approximately correspond to the diameter of the cable sheath 9, it may be advantageous for at least one of the plug-in connector components 24, 25, 26, 27, 28 to be pushed onto the cable sheath 9 using a lubricant, preferably an alcohol or a silicone oil. A lubricant may possibly also be suitable for attaching or pushing-on the sheath clamps 10.1, 10.2, 10.3, 10.4. Provision may be made, for example, to provide the cable sheath 9, the plug-in connector component (s) 24, 25, 26, 27, 28 and/or the sheath clamp(s) 10.1, 10.2, 10.3, 10.4 with a lubricant. In the exemplary embodiment, means 39 are provided (cf. FIG. 4) in order to apply the lubricant to the front end 6, 7 of the cable 2 by means of two brushes before the cable 2 is inserted into the fitting module 33.

A suitable fitting method may be carried out by means of a computer program product with program code means on the control unit 16 of the device 1 for manufacturing the cable 2, as indicated in FIGS. 4 and 5.

Figure 6:
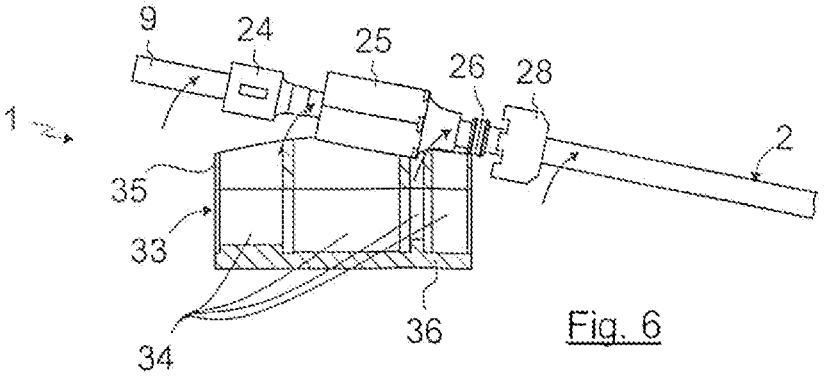
FIG. 6 shows a detail view of the fitting module of FIG. 4 during removal of the electric cable.

The cable 2 fitted with the plug-in connector components 24, 25, 26, 27, 28 (and/or sheath clamps 10.1, 10.2, 10.3, 10.4) may, after the cable 2 has been led through the plug-in connector components 24, 25, 26, 27, 28 (and/or sheath clamps 10.1, 10.2, 10.3, 10.4), be removed from the fitting module 3, for example, laterally with respect to the push-in direction of the cable 2 or counter to the push-in direction of the cable 2, as indicated in FIG. 6.

Figure 7:
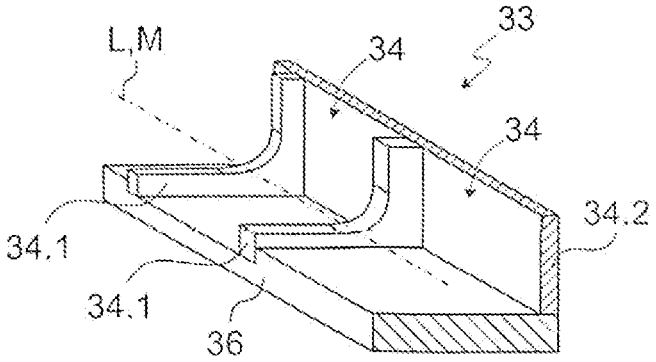
FIG. 7 shows a perspective sectional illustration of two chambers of the fitting module of FIG. 4.

FIG. 7 illustrates an enlarged perspective sectional illustration of a detail of the fitting module 33. The detail shows, by way of example, two chambers 34 of the fitting module 33. The chambers 34 are separated from one another by partition walls 34.1, which may have different wall thicknesses in order to realize the distances $d_1$, $d_2$, $d_3$, $d_4$. The partition walls 34.1 simultaneously serve as a stop for the plug-in connector components 24, 25, 26, 27, 28 (and/or sheath clamps 10.1, 10.2, 10.3, 10.4) that have been inserted into the chambers 34. The partition walls 34.1 are further designed to leave a cutout around the center axis M, in the region of the channel K, for leading the cable 2 through the plug-in connector components 24, 25, 26, 27, 28 (and/or sheath clamps 10.1, 10.2, 10.3, 10.4). The base 36 of the fitting module 33 has steps in order to provide different height levels for the respective plug-in connector components 24, 25, 26, 27, 28 (and/or sheath clamps 10.1, 10.2, 10.3, 10.4) within the chambers 34 in order to render possible a continuous channel K or coaxial positioning of the plug-in connector components 24, 25, 26, 27, 28 (and/or sheath clamps 10.1, 10.2, 10.3, 10.4). In order to prevent the plug-in connector components 24, 25, 26, 27, 28 (and/or sheath clamps 10.1, 10.2, 10.3, 10.4) from falling out laterally, side walls 34.2 may also be provided. In the exemplary embodiment, only one rear side wall 34.2 is provided in order to still be able to remove the fitted cable 2, as indicated in FIG. 6, laterally from the fitting module 33. However, the magazine 35 (hidden in FIG. 7) arranged above the fitting module 33 preferably has side walls 34.2 on both sides. The base 36, the side walls 34.2 and/or the partition walls 34.1 may optionally be designed to keep ready the plug-in connector components 24, 25, 26, 27, 28 (and/or sheath clamps 10.1, 10.2, 10.3, 10.4) with a predefined alignment or orientation.

Finally, FIG. 8 shows a system 40 for manufacturing an electric cable 2. The illustrated system 40 comprises the device 1 for manufacturing the electric cable 2 with a fitting module 33 for fastening at least one sheath clamp 10.1, 10.2, 10.3, 10.4 to the cable sheath 9 of the cable 2. The device 1 is preferably designed as described above. The device 1 may also be designed for fitting the cable sheath 9 with the plug-in connector components 24, 25, 26, 27, 28. The device 1 may also be designed for documenting the cable processing.

The system 40 comprises further processing modules 41, 43, independent of the device 1, for manufacturing the electric cable 2.

In the context of the system 40, the device 1 is preferably arranged downstream of a processing module, not illustrated in any detail, for aligning, receiving and orienting the cable 2. The cable 2 is preferably fitted with the plug-in connector components 24, 25, 26, 27, 28 and/or the sheath clamps 10.1, 10.2, 10.3, 10.4 on an initially still unprocessed electric cable 2.

FIG. 8 shows, once again by way of example, a workpiece carrier system 3 in order to feed the cable section, to be processed, of the cable 2 to the individual processing modules 41, 43 or to the device 1 in succession. Depending on the quantities to be manufactured, the illustrated transportation device 8 may also be dispensed with. In this case, the cable 2 or the cable sections may also be transported between the individual processing modules 41, 43 or the device 1 by a production technician, for example including with the aid of a roller track. By way of example, the transportation device 8 is designed in the form of a transporting belt and transports a plurality of cables 2 fastened to a cable carrier 4 from processing module 41, 43 to processing module 41, 43 in order to utilize all of the processing modules 41, 43 to capacity as far as possible continuously and therefore to achieve a high throughput during cable processing.

By way of example, a first processing module 41 for fitting a contact parts carrier 42 is illustrated downstream of the device 1. After fitting the contact parts carrier 42, the frontmost sheath clamp 10.1 may be removed in order to push the shielding sleeve 24 onto the contact parts carrier 42, starting from the cable sheath 9, and to compress said shielding sleeve with the contact parts carrier 42.

In turn, by way of example, a second processing module 43 for fitting the plug-in connector housing 25 of the plug-in connector 22 is shown arranged downstream of the first processing module 41. In order to clear the displacement path for the plug-in connector housing 25, a further sheath clamp 10.1 may be removed.

Any desired further processing modules may be provided below in order to assemble the plug-in connector 22 bit by bit.

Figure 9:
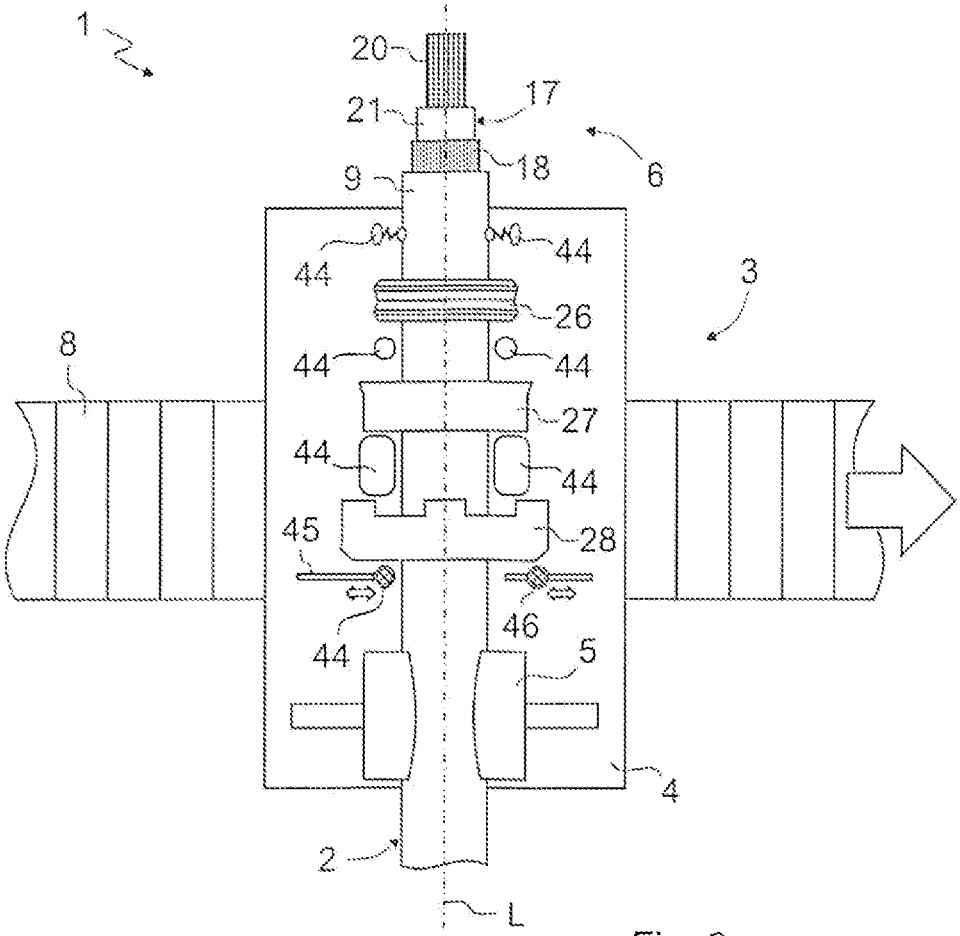
FIG. 9 shows a cable carrier with various stop elements in order to block the displacement path of plug-in connector components on the cable sheath.

As an alternative, or in addition, to the use of sheath clamps 10.1, 10.2, 10.3, 10.4, provision may also be made for the cable 2 to be fastened to a cable carrier 4 which has stop elements 44 arranged at defined axial positions along the longitudinal axis L, as illustrated in FIG. 9 by way of example.

FIG. 9 shows a cable carrier 4 as part of a workpiece carrier system 3, similar to the cable carriers 4 already described above. The cable 2 is held by clamping jaws 5. Various stop elements 44 are provided, for example in the form of webs or pins, in order to block the displacement path of the plug-in connector components 24, 25, 26, 27, 28 on the cable sheath 9 of the cable 2 in a positively locking fashion. Different types of stop elements 44 are shown in FIG. 9 for illustration purposes. In each case two mutually opposite stop elements 44 or two stop elements 44, each located at the same axial position along the longitudinal axis L of the cable 2, which form a common stop element pair are preferably provided.

The stop elements 44 may be able to be flexibly fitted or positioned on the cable carrier 4 in order to assume various axial positions as required. The stop elements 44 may be able to be positioned on the cable carrier freely or in a specified pattern The stop elements 44 may optionally be able to be fed in the direction of the longitudinal axis L of the cable 2, for example manually along a respective guide rail 45, wherein the end position of the stop elements 44 may be able to be fixed, for example by tightening a screw 46.

The stop elements 44 may optionally also be of elastic form in order to bear against the cable sheath 9 in a non-positively locking fashion when the cable 2 is in the inserted state (cf., for example, the frontmost stop element pair).

OPERATION

Having described the structure of our Electrical Plug Connector, Connecting Element, and Printed Circuit Board Arrangement, its operation is briefly described.

A principal object of the present invention is to provide a method for manufacturing an electric cable according to which method the electric cable 2 is processed in mutually independent processing modules 41, 43 in succession, and wherein a cable sheath 9 of the electric cable 2 is fitted with one or more plug-in connector components 24, 25, 26, 28 for later fitting of a plug-in connector 22 by the mutually independent processing modules 41, 43 starting from a front, free end 6, 7 of the electric cable 2, characterized in that at least one sheath clamp 10.1, 10.2, 10.3, 10.4, which is independent of the plug-in connector 22 to be fitted on the electric cable 2 in the course of the manufacturing process, is fastened to the cable sheath 9 of the electric cable 2 in a non-positively locking fashion and at a defined axial position along a longitudinal axis (L) of the electric cable 2, and the at least one sheath clamp 10.1, 10.2, 10.3, 10.4 is arranged axially adjacent to the one or more plug-in connector components 24, 25, 26, 27, 28 on the cable sheath 9 to block a displacement path of the one or more plug-in connector components 24, 25, 26, 27, 28 on the cable sheath 9 in positively locking fashion.

A further object of the present invention is to provide a method for manufacturing an electric cable 2, according to which method the electric cable 2 is processed in mutually independent processing modules 41, 43 in succession, and wherein a cable sheath 9 of the electric cable 2 is fitted with one or more plug-in connector components 24, 25, 26, 27, 28 for later plug-in connector 22 fitting by the mutually independent processing modules 41, 43 starting from a front, free end 6, 7 of the electric cable number 2, characterized in that the electric cable 2 is fastened to a cable carrier 4, and wherein the cable carrier 4 has at least one stop element 44 which is arranged at a defined axial position along a longitudinal axis (L) of the electric cable 2, and the at least one stop element 44 of the cable carrier 4 is arranged axially adjacent to the one or more plug-in connector components 24, 25, 26, 27, 28 along the longitudinal axis (L) of the electric cable 2 in order to block a displacement path of the one or more plug-in connector components 24, 25, 26, 27, 28 on the cable sheath 9 in a positively locking fashion.

A further object of the present invention is to provide a method for manufacturing an electric cable 2 comprising the steps: providing an electric cable 2 that defines a longitudinal axis L, and which has a front free end 6, 7, and which has a cable sheath 9; providing one or more plug-in connector components 24, 25, 26, 27, 28 for fitting to the cable sheath 9 of the electric cable 2; providing plural processing modules 41, 43 for fitting the one or more plug-in connector components 24, 25, 26, 27, 28 to the cable sheath 9 of the electric cable 2, and wherein each of the plural processing modules 41, 43 is mutually independent from others of the plural processing modules 41, 43, and wherein each of the plural mutually independent processing modules 41, 43 processes the electric cable 2 in succession; fitting the one or more plug-in connector components 24, 25, 26, 27, 28 to the cable sheath 9 of the electric cable 2 by means of the plural mutually independent processing modules 41, 43, starting from the front free end 6, 7 of the electric cable 2; providing at least one sheath clamp 10.1, 10.2, 10.3, 10.4 which is independent of a plug-in connector 22 to be fitted on the cable sheath 9 of the electric cable 2; fastening the at least one sheath clamp 10.1, 10.2, 10.3, 10.4 to the cable sheath 9 of the electric cable 2 in a non-positively locking fashion and at a defined axial position along the longitudinal axis (L) of the electric cable 2; and wherein the at least one sheath clamp 10.1, 10.2, 10.3, 10.4 is axially adjacent to the one or more plug-in connector components 24, 25, 26, 27, 28 on the cable sheath 9 to block a displacement path of the one or more plug-in connector components 24, 25, 26, 27, 28 on the cable sheath 9 in a positively locking fashion.

A further object of the present invention is a method for manufacturing an electric cable 2 comprising the steps: providing an electric cable 2 that defines a longitudinal axis L, and which has a front free end 6,7, and which has a cable sheath 9; providing one or more plug-in connector components 24, 25, 26, 27, 28 for fitting to the cable sheath 9 of the electric cable 2; providing plural processing modules 41, 43 for fitting the one or more plug-in connector components 24, 25, 26, 27, 28 to the cable sheath 9 of the electric cable 2, and wherein each of the plural processing modules 41, 43 is mutually independent from others of the plural processing modules 41, 43, and wherein each of the plural mutually independent processing modules 41, 43 processes the electric cable 2 in succession; fitting the one or more plug-in connector components 24, 25, 26, 27, 28 to the cable sheath 9 of the electric cable 2 by means of the plural mutually independent processing modules 41, 43, starting from the front free end 6, 7 of the electric cable 2; providing a cable carrier 4 and fitting the electric cable 2 to the cable carrier 4, and wherein the cable carrier 4 has at least one stop element 44 which is arranged at a defined axial position along the longitudinal axis L of the electric cable 2; and wherein the at least one stop element 44 of the cable carrier 4 is arranged axially adjacent to the one or more plug-in connector components 24, 25, 26, 27, 28 along the longitudinal axis L of the electric cable 2 to block a displacement path of the one or more plug-in connector components 24, 25, 26, 27, 28 on the cable sheath 9 in a positively locking fashion.

A further object of the present invention is to provide a method for manufacturing an electric cable 2 wherein the at least one sheath clamp 10.1, 10.2, 10.3, 10.4 is pushed onto the cable sheath 9 of the electric cable 2 starting from the front, free end 6, 7 of the electric cable 2 until the defined axial position is reached.

A further object of the present invention is to provide a method for manufacturing an electric cable 2 wherein the at least one sheath clamp 10.1, 10.2, 10.3, 10.4 is attached to the cable sheath 9 of the electric cable 2 at a defined axial position radially in the direction of a center axis (M) of the electric cable 2.

A further object of the present invention is to provide a method for manufacturing an electric cable 2 wherein the at least one sheath clamp 10.1, 10.2, 10.3, 10.4 is removed from the cable sheath 9 of the electric cable 2 again after processing by at least one of the plural mutually independent processing modules 41, 43.

A further object of the present invention is to provide a method for manufacturing an electric cable 2 and further comprising: providing an information carrier 11.1, 11.2 on the at least one sheath clamp 10.1, 10.2, 10.3, 10.4; and the at least one sheath clamp 10.1, 10.2, 10.3, 10.4 is made identifiable by the information carrier 11.1, 11.2 in order to be able to uniquely identify the electric cable 2 while the electric cable 2 is being processed.

A still further object of the present invention is to provide a method for manufacturing an electric cable 2 wherein documentation 13 of the processing of the electric cable 2 is compiled for at least one processing process of at least one of the plural mutually independent processing modules 41, 43 and is assigned to the sheath clamp 10.1, 10.2, 10.3, 10.4 which is fastened to the electric cable 2.

A still further object of the present invention is to provide a method for manufacturing an electric cable 2 wherein the documentation 13 is at least partially imprinted into the information carrier 11.1, 11.2 on the at least one sheath clamp 10.1, 10.2, 10.3, 10.4.

A still further object of the present invention is to provide a method for manufacturing an electric cable 2 and further comprising: a unique identifier 14 for the electric cable 2 that is imprinted into the information carrier 11.1, 11.2 or a unique identifier 14 which is already present on the information carrier 11.1, 11.2 is assigned to the electric cable 2.

A still further object of the present invention is to provide a method for manufacturing an electric cable 2 wherein the information carrier 11.1, 11.2 is of optical form and/or electronic form.

A still further object of the present invention is to provide a method for manufacturing an electric cable 2 wherein the optical information carrier 11.1 is a barcode, numerical code, a 2D code, a data matrix code or a QR code.

A still further object of the present invention is to provide a method for manufacturing an electric cable 2 wherein the optical and/or electronic information carrier 11.2 comprises at least one programmable memory module, for example an RFID transponder, which is modified to identify the electric cable 2 and/or to document the processing of the electric cable 2.

A still further object of the present invention is to provide a method for manufacturing an electric cable 2 and further comprising the steps providing a fitting module 33 that has individual chambers 34 for receiving the one or more plug-in connector component 24, 25, 26, 27, 28 and at least one sheath clamp 10.1, 10.2, 10.3, 10.4, and the individual chambers 34 of the fitting module 33 are arranged in such a way that the one or more plug-in connector components 24, 25, 26, 27, 28 and the at least one sheath clamp 10.1, 10.2, 10.3, 10.4 which are received in the individual chambers 34 form a common channel (K) that defines a common center axis (M); and providing an actuator 37 that conducts the electric cable 2, by way of the electric cable front free end 6, 7, along a center axis (M) through the one or more plug-in connector components 24, 25, 26, 27, 28 and the at least one sheath clamp 10.1, 10.2, 10.3, 10.4 to push the one or more plug-in connector components 24, 25, 26, 27, 28 and the at least one sheath clamp 10.1, 10.2, 10.3, 10.4 axially onto the cable sheath 9 of the electric cable 2.

A still further object of the present invention is to provide a method for manufacturing an electric cable 2 wherein the fitting module 33 has a magazine 35 to keep ready further one or more plug-in connector components 24, 25, 26, 27, 28 or further sheath clamps (10.1, 10.2, 10.3, 10.4) for fitting further electric cables 2.

A still further object of the present invention is to provide a device 1 for manufacturing an electric cable 2 comprising: a fitting module 33—to fasten a sheath clamp 10.1, 10.2, 10.3, 10.4 to a cable sheath 9 of the electric cable 2, and the sheath clamp 10.1, 10.2, 10.3, 10.4 is independent of a plug-in connector 22 to be fitted on the electric cable 2 in the course of the manufacturing of the electric cable 2, and the sheath clamp 10.1, 10.2, 10.3, 10.4 is fitted onto the cable sheath 9 of the electric cable 2 in a non-positively locking fashion, and at a defined axial position along a longitudinal axis (L) of the electric cable 2.

A still further object of the present invention is to provide a cable carrier 4 for receiving an electric cable 2 to be manufactured, the cable carrier 4 comprising: a least one stop element 44 at a defined axial position along a longitudinal axis (L) of the electric cable 2 received by the cable carrier 4—to block a displacement path of plug-in connector components 24, 25, 26, 27, 28 on a cable sheath 9 of the electric cable 2 in a positively locking fashion, and wherein the at least one stop element 44 is formed as pin or web on the cable carrier 4.

A still further object of the present invention is to provide a method for manufacturing an electric cable 2 wherein at least one sheath clamp 10.1, 10.2, 10.3, 10.4 is removed from the cable sheath 9 of the electric cable 2 again after processing by all of the plural mutually independent processing modules 41, 43.

An even still further objet of the present invention is to provide a device for manufacturing an electric cable 2 comprising a cable carrier 4 to which the electric cable 2 can be fastened, and wherein the cable carrier 4 has at least one stop element 44 which is arranged at a defined axial position along the longitudinal axis (L) of the electric cable 2.

In compliance with the statute, the present invention has been described in language more or less specific, as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalents.

The invention claimed is:

1. A method for manufacturing an electric cable comprising the steps:

providing an electric cable that defines a longitudinal axis, and which has a front free end, and which has a cable sheath;

providing one or more plug-in connector components for fitting to the cable sheath of the electric cable;

providing plural processing modules for processing of the electric cable, and wherein each of the plural processing modules is mutually independent from others of the plural processing modules, and wherein each of the plural mutually independent processing modules processes the electric cable in succession;

providing a cable carrier and fitting the electric cable to the cable carrier, and wherein the cable carrier has at least one stop element which is arranged at a defined axial position along the longitudinal axis of the electric cable; and wherein the at least one stop element of the cable carrier is arranged axially adjacent to the one or more plug-in connector components along the longitudinal axis of the electric cable to block a displacement path of the one or more plug-in connector components on the cable sheath in a positively locking fashion.

* * * * *